US007387458B2

(12) United States Patent
Monteith et al.

(10) Patent No.: US 7,387,458 B2
(45) Date of Patent: Jun. 17, 2008

(54) PRINTER AND METHOD OF PRINTING WITH A PLURALITY OF SELECTABLE REGISTRATION SENSORS

(75) Inventors: John R. Monteith, Dayton, OH (US); Mitchell G. Stern, Centerville, OH (US); Clyde N. Tharp, Hillsboro, OH (US)

(73) Assignee: Paxar Americas, Inc., Miamisburg, OH (US)

( * ) Notice: Subject to any disclaimer, the term of this patent is extended or adjusted under 35 U.S.C. 154(b) by 673 days.

(21) Appl. No.: 10/640,071

(22) Filed: Aug. 13, 2003

(65) Prior Publication Data

US 2005/0036819 A1 Feb. 17, 2005

(51) Int. Cl.
*B41J 11/00* (2006.01)

(52) U.S. Cl. ..... 400/609; 400/584; 400/587; 400/613; 347/104; 347/215; 226/109

(58) Field of Classification Search ..... 400/584–587, 400/609, 613; 347/104, 215; 156/384, 387; 226/109; 206/391, 394
See application file for complete search history.

(56) References Cited

U.S. PATENT DOCUMENTS 579,676 A * 3/1897 Graham ..... 178/23 R
1,208,757 A * 12/1916 Dennis ..... 400/588
1,531,875 A * 3/1925 Ray ..... 400/585.1
1,641,929 A * 9/1927 Kurowski ..... 400/584
2,352,445 A * 6/1944 Pinckney ..... 225/20
2,639,019 A * 5/1953 Anderson ..... 400/600.4
3,371,776 A * 3/1968 Voissem ..... 206/394
3,692,222 A 9/1972 Pargeon
4,191,608 A 3/1980 Bussard
4,229,113 A * 10/1980 Anderson et al. ..... 400/596
4,407,692 A 10/1983 Torbeck
4,415,287 A * 11/1983 Wincent ..... 400/322
4,706,099 A 11/1987 Suzuki
4,957,179 A 9/1990 Dannatt
5,139,353 A * 8/1992 Ota ..... 400/584
5,222,291 A * 6/1993 Ota et al. ..... 29/611
5,267,800 A * 12/1993 Petteruti et al. ..... 400/88
5,546,178 A 8/1996 Manzer et al.
5,708,462 A 1/1998 Heimbold
5,791,794 A * 8/1998 Kopp et al. ..... 400/584
5,838,354 A 11/1998 Yamada et al.
6,120,142 A 9/2000 Eltgen et al.
6,241,407 B1 6/2001 Huggins
6,398,360 B1 6/2002 Brewington et al.
6,579,021 B2 6/2003 Deshayes
6,609,844 B1 * 8/2003 Petteruti et al. ..... 400/88
6,619,361 B1 9/2003 Swinburne
2004/0022568 A1 * 2/2004 Menendez et al. ..... 400/76

FOREIGN PATENT DOCUMENTS

JP 2001121773 A * 5/2001

* cited by examiner

*Primary Examiner*—Jill E. Culler
(74) *Attorney, Agent, or Firm*—Joseph J. Grass

(57) ABSTRACT

There is disclosed a portable printer and a method of selectively printing on any one of a plurality of label rolls housed in the printer, or on a wide roll housed in the printer.

4 Claims, 29 Drawing Sheets

FIG. 1
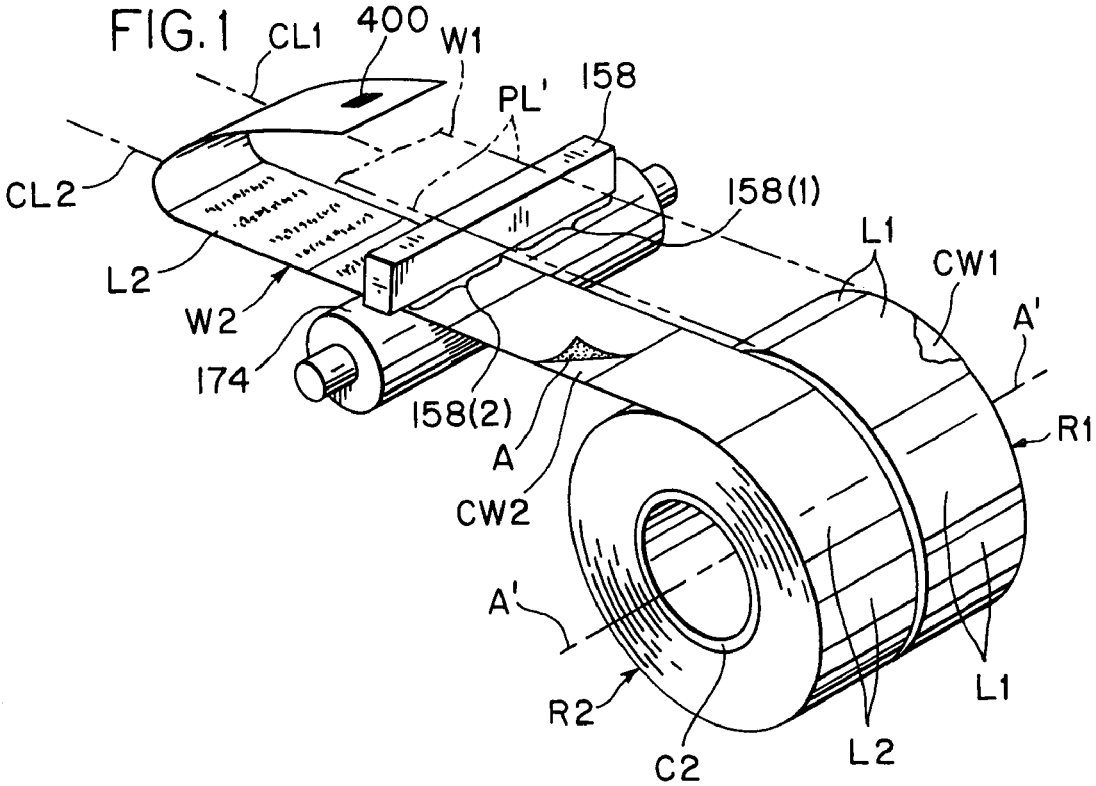
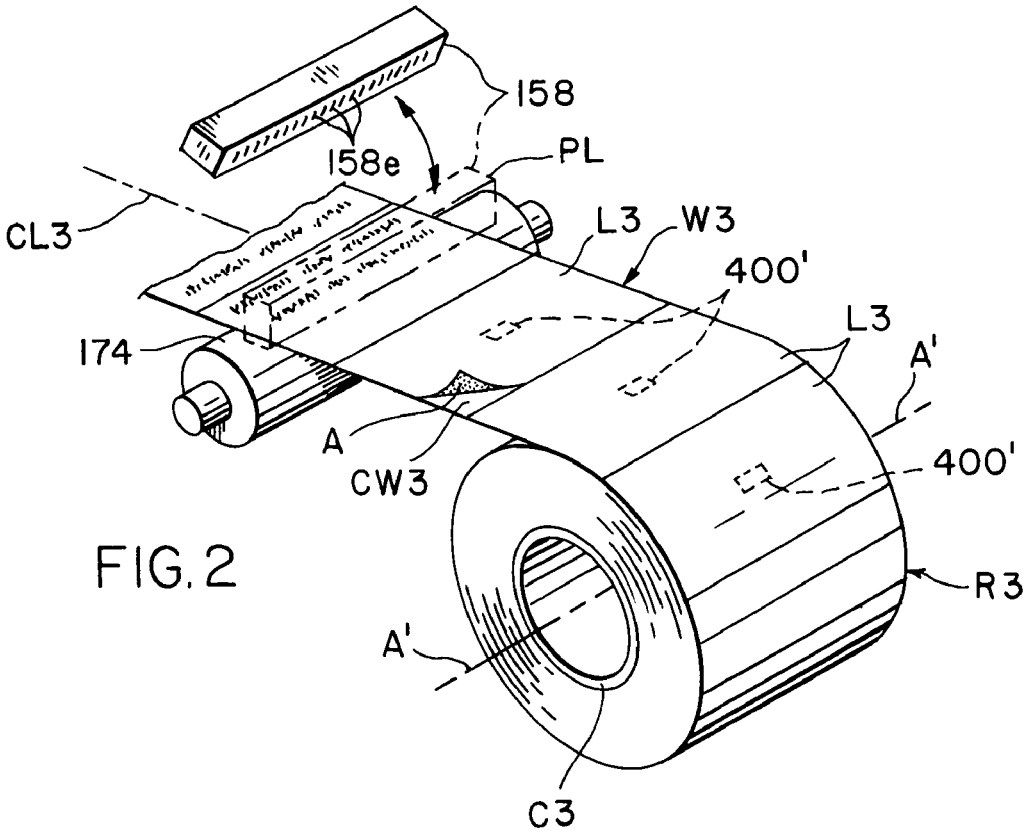
FIG. 2

P
Print one Dot Line of Data
560
M
Is Switch to the Right Side?
562
No
Is Switch to the Left side?
568
No
Yes
Yes
Read Right Side Sensor
564
Read Left Side Sensor
570
Read Center Sensor
572
Does Sensor Indicate Out-of-Stock?
566
YES
NO
Stop Printing
574
Stop Motor
576
Monitor Position of Black Mark and begin printing upon proper registration
580
Report Out-of-Stock Error
578
C
EXIT

PRINTER AND METHOD OF PRINTING WITH A PLURALITY OF SELECTABLE REGISTRATION SENSORS

BACKGROUND OF THE INVENTION

1. Field of the Invention

This invention relates to the printing art.

2. Brief Description of the Prior Art

The following prior art is made of record: U.S. Pat. Nos. 3,692,222; 4,191,608; 4,407,692; 4,957,179; 5,708,462; 6,241,407 and 6,579,021.

SUMMARY OF THE INVENTION

The invention relates to an improved method of printing and to an improved printer.

According to a specific embodiment of the method of the invention, a plurality of label rolls of label webs can be positioned for printing by a print head, and any selected label web can be passed into printing cooperation with and printed by the print head. The label rolls can be disposed in side-by-side relationship preferably in a common axis. The print head is preferably elongate and extends transverse to the label webs at the printing position. The label webs can move along different label web paths longitudinally with respect to the print head. There is preferably a label sensor in each label web path so that the labels may be registered with respect to the print head. The labels can have different characteristics, for example, if two label rolls are provided, one label roll can have a characteristic for mark-downs, and such labels may be color-coded, e.g., red, or they can be pre-printed with "old price/new price" legends, and another label roll can have a characteristic for mark-ups and such labels may be color-coded, e.g., white. Thus, assuming it is desired to mark a price down, the mark-down roll can be partially unwound and passed along a path into the printing position with respect to the print head, whereas the mark-up roll can be left in position to be used in the event mark-up labels are later desired to be printed. When it is desired to print mark-up labels, then the mark-down label web is removed from printing cooperation with the print head and the web of mark-up labels is partially unwound from the mark-up roll and is passed along a different path to the print head. In this way, the option of printing either mark-down labels or mark-up labels is readily available to the user in a single printer. The method of the invention is, of course, not limited to printing mark-down and mark-up labels, but is applicable in general when it is desired to print labels from two or more rolls.

In accordance with the invention, the method is applicable for use with a printer capable of mounting both a single wide roll or a plurality of narrower rolls. Preferably, a holder is provided which can hold a plurality of label rolls, and the holder together with the label rolls can be loaded into another holder in a printer.

It is a feature of the invention to provide a plurality of longitudinally extending paths leading to an elongate transversely extending print head, wherein each path is selectable to pass a label web along its respective path to be printed by a portion of the print head aligned with the path, and a selected roll of a plurality of rolls mounted in relation to the print head can be passed along one of the paths into printing cooperation with the print head.

The invention also relates to a printer capable of carrying out the improved method. A printer according to one embodiment provides space for receiving a plurality of rolls of label webs. The printer is provided with sensors disposed along the label paths from the rolls to the print head. The sensors register the labels with the print head. It is preferred that the printing occurs while the selected web is advancing. While the printer may be a hand-held or portable printer, the invention is applicable to table-top and other printers as well.

Various other features and advantages will occur to those skilled in the art when referencing the following description and the accompanying drawings.

BRIEF DESCRIPTION OF THE DIAGRAMMATIC DRAWINGS

FIG. 1 is a perspective view illustrating a pair of narrow label rolls of label webs, one of which is threaded between a print head and a platen roll;

FIG. 2 is a perspective, partly exploded view illustrating a single wide label roll of a label web threaded between the print head and the platen roll, with the print head being exploded away from the platen roll and rotated to show a straight line of thermal heating elements;

DETAILED DESCRIPTION OF THE PREFERRED EMBODIMENTS

Figure 3:
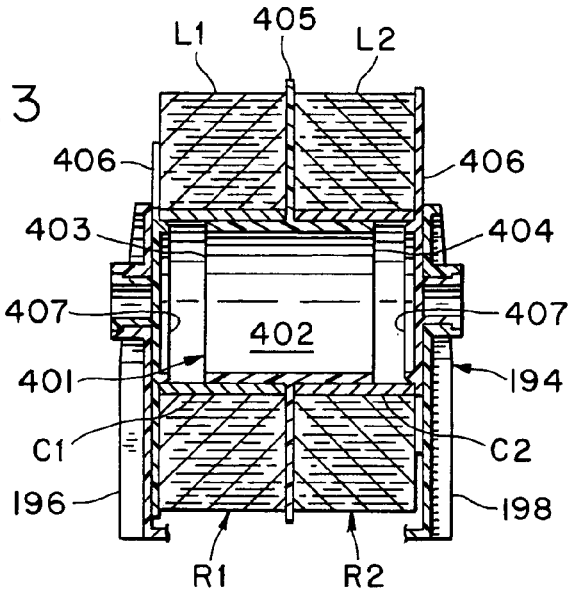
FIG. 3 is a sectional view of a pair of rolls mounted on a holder, and the holder and the labels in turn being mounted on another holder.

With reference to FIG. 1, there is illustrated a pair of rolls R1 and R2 of respective composite label webs W1 and W2. The rolls R1 and R2 are shown to have respective cores C1 (FIGS. 3 and 4) and C2, although coreless rolls (not shown) can be used. The web W1 has labels L1 releasably adhered by pressure sensitive adhesive A (FIG. 16) to a flexible carrier web CW1, and the web W2 has labels L2 releasably adhered by pressure sensitive adhesive A to a flexible carrier web CW2. The webs W1 and W2 of rolls R1 and R2 are identical except that in the illustrated embodiment, the labels L1 and L2 have different color and/or can have different pre-printed information than the labels L2. For example, the labels L1 can be white in color and the labels L2 can be red in color. FIG. 1 illustrates the label web W2 as being threaded along a path having a center line CL2 from the roll R2 to between a print head 158 and a platen roll 174. The print head 158 is illustrated to be a thermal print head having a straight line of individual or dot heating elements 158*e* (FIG. 2), however, other types of print heads can be used instead. The print head 158 is shown exploded away from its printing position represented by phantom lines PL in FIG. 2. The print head 158 is shown to be elongate and essentially fixed in place or stationary except the print head 158 is resiliently mounted with respect to the platen roll 174. The web W1 is shown extending outwardly away from the roll R1 by the phantom lines PL' because only one web W1 or W2 at a time is threaded to pass between the print head 158 and the platen roll 174. Thus, if the web W1 were threaded to pass along a path as shown in FIG. 1 by phantom lines PL', the web W2 would remain on the roll R2 and would not be threaded between the print head 158 and the platen roll 174. The centerline of the path for the web W1 is shown to be CL1. The centerlines CL1 and CL2 pass through longitudinally spaced registration marks 400 on the webs W1 and W2, there being one registration mark 400 per label. The web W2 is shown in FIG. 1 with a U-shaped bend to expose the registration marks RW. The rolls R1 and R2 are preferably disposed in side-by-side relationship as shown, and also the rolls R1 and R2 are preferably disposed on a common axis A', although other relationships and dispositions can be used. The webs W1 and W2 and their center lines CL1 and CL2 are shown to be parallel. The webs W1 and W2 can move longitudinally in label paths that extend between the elongate transversely extending print head 158 and the platen roll 174. The web W1 would be printed by only that portion 158(1) of the print head 158 which lies along the label web path of the label web W1, and likewise the web W2 would be printed by only that portion 158(2) of the print head 158 which lies along the label path of the label web W2.

While FIG. 1 illustrates a plurality, namely, two narrow label rolls R1 and R2, FIG. 2 illustrates that the same printer 26 (FIG. 5) can be used to print a wide roll R3 of a wide web W3 of labels L3. The wide roll R3 can be located on the printer 26 in the same space as the rolls R1 and R2. The web W3 is shown to have medially located registration marks 400' along the centerline CL3 of the label web W3 and its label web path. As shown, the web W3 can be approximately as wide as the length of the elongate print head 158. Like the rolls R1 and R2, the roll R3 preferably has a core C3. Like the composite webs W1 and W2, the composite web W3 includes a carrier web CW3 for the labels L3.

Figure 4:
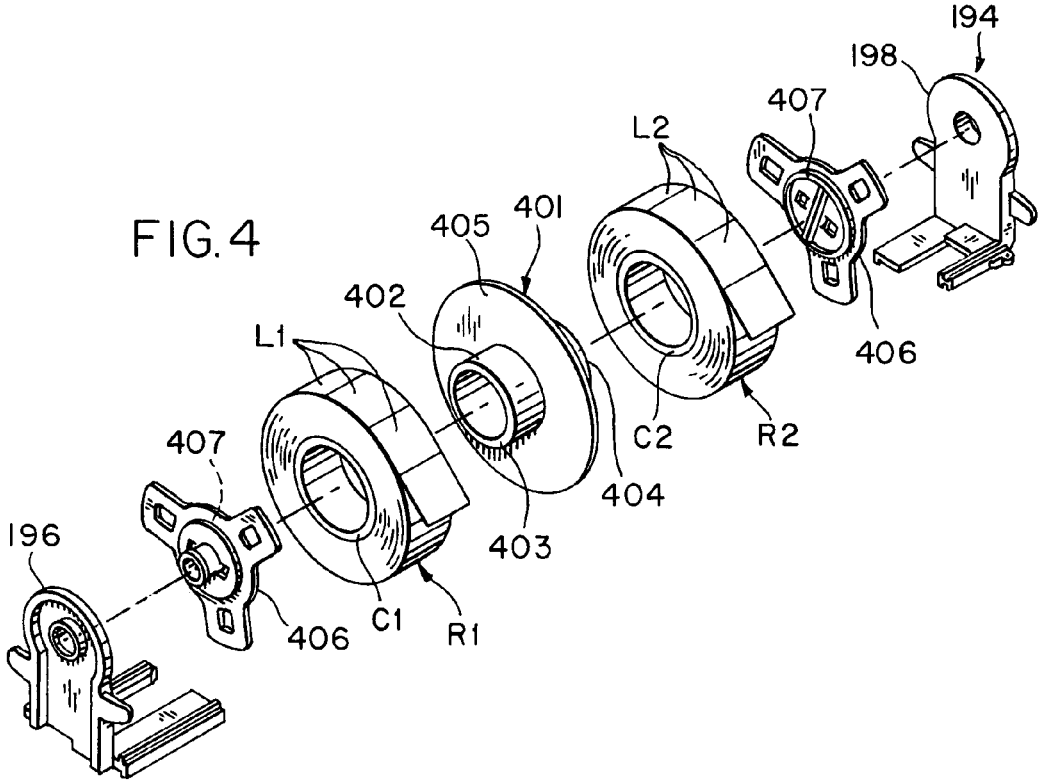
FIG. 4 is an exploded perspective view of the label rolls and holders shown in FIG. 3.

With reference to FIGS. 3 and 4, the rolls R1 and R2 are shown mounted on a holder generally indicated at 401 for holding the rolls in side-by-side relationship. The holder 401 includes a tube or shaft 402 having open ends 403 and 404. The shaft 402 is preferably hollow and the ends 403 and 404 are open. As shown, the length of the shaft 402 is less than the combined widths of the rolls R1 and R2. A flange or separator 405 is mounted on the shaft, and in particular the separator 404 is preferably attached to the outside of the shaft 402 and extends radially outwardly of the shaft 402. The holder 401 is preferably of one-piece molded plastics construction. The outside diameter of the shaft 402 is preferably slightly less than the inside diameter of each of cores C1 and C2. A holder 194 includes a pair of identical holder members 196 and 198 each having a preferably rotatably mounted hub 406. The invention does not require rotatable hubs. The holder members 196 and 198 are each movable in unison toward and away from each other to enable supply rolls of different widths to be held by the holder 194. The hubs 406 have opposed inwardly extending projections 407 received in the marginal end portions of the cores C1 and C2 as best shown in FIG. 3. Thus, the holder 401 mounts the rolls R1 and R2 as a unit and the holder 194 mounts the rolls R1 and R2 and the holder 401 as a unit. Thus, by spreading the holder numbers 196 and 198 of the holder 194 against the force of a spring 228, the holder 401 and the rolls R1 and R2 which it carries can be loaded onto the holder members 196 and 198. In that the ends 403 and 404 terminate short of the projections 407 as seen in FIG. 3, the projections 407 are able to extend into the insides of the cores C1 and C2 without interference. To remove the core C1 and/or core C2 of a spent roll R1 and/or roll R2, the holder members 196 and 198 are manually moved apart, and the holder 401 can be removed along with the rolls R1 and/or R2 and/or cores C1 and/or C2.

When the label web W1 or W2 is drawn from the roll R1 or R2, the holder 401 and both rolls R1 and R2 can rotate together as a unit with the hubs 406.

It is apparent that when it is desired to print on a wide web W3 of a wide roll R3, the roll R3 can simply be mounted on the hubs 406 and printed in the printer 26 by passing the web W3 to the printing position between the print head 158 and platen roll 174 as shown in FIG. 2.

Figure 16:
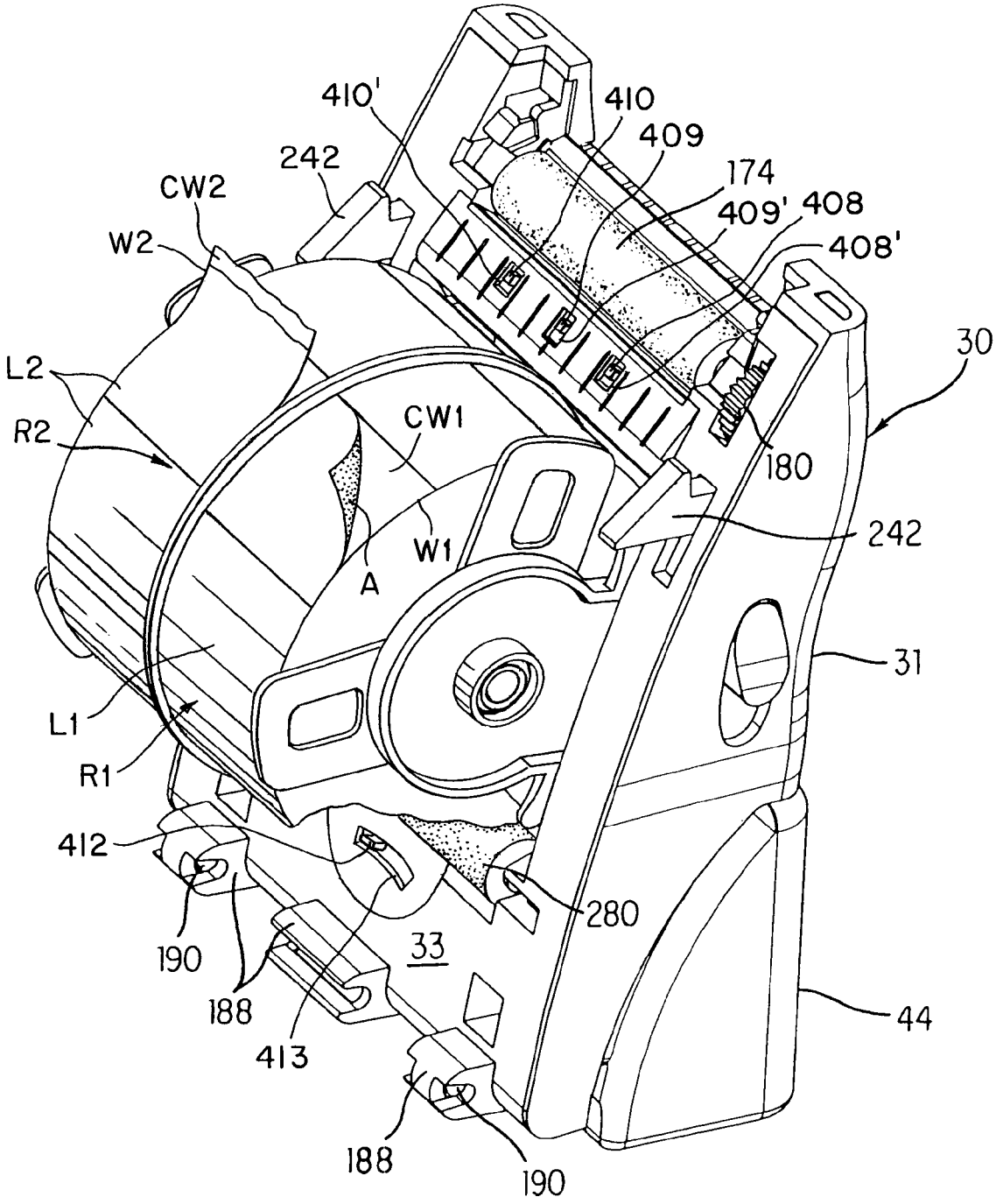
FIG. 16 is a perspective view of the door, a supply roll mounted on the door, the platen roll and gear, and part of the latch.
Figure 17:
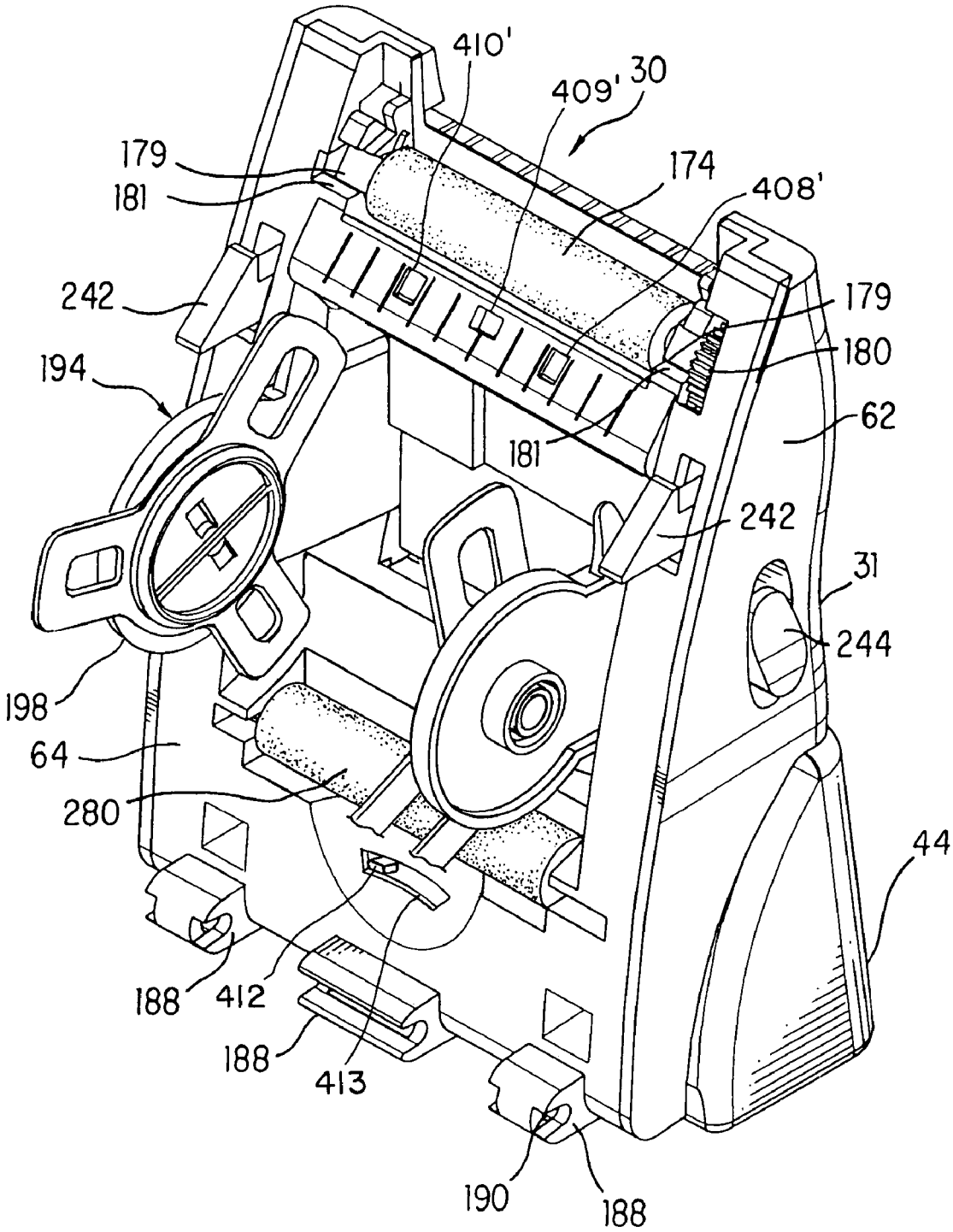
FIG. 17 is a perspective view similar to FIG. 16, but showing the supply roll removed.
Figure 19:
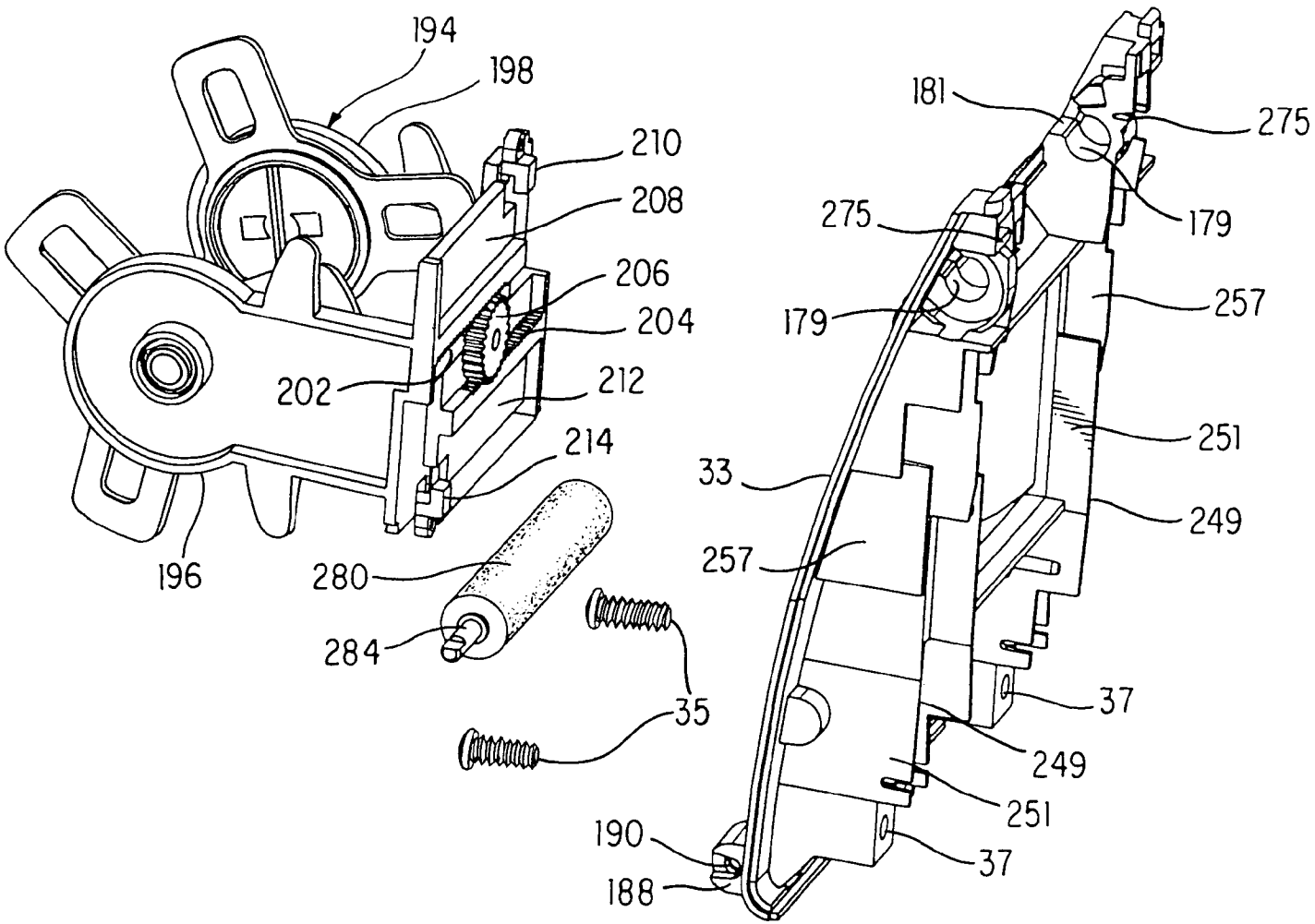
FIG. 19 is an exploded perspective view of the supply roll holder and the inner door panel shown in FIG. 18.
Figure 22:
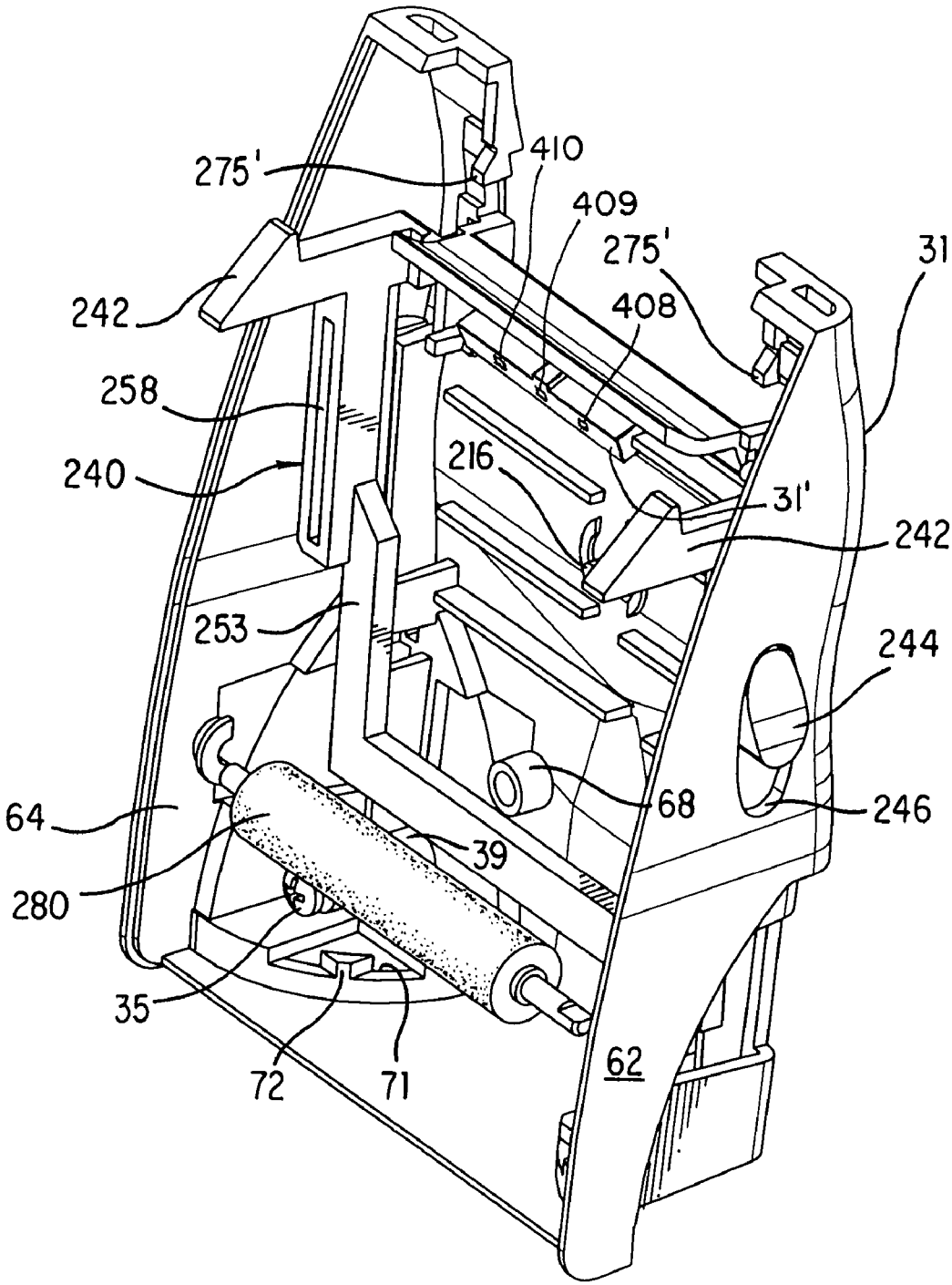
FIGS. 22 and 23 are perspective views showing the latch assembled onto the outer door panel.

As shown in FIG. 22, an outer panel 31 mounts a circuit board 31' with three optical sensors 408, 409 and 410. The sensors 408, 409 and 410 are mounted adjacent the driven platen roll 174 as shown in FIG. 16 for example. The sensors 408, 409 and 410 sense the webs W1, W3 and W2, respectively, through holes 408', 409' and 410' in inner door panel 33 (FIG. 19 for example). The sensors 408, 409 and 410 are aligned with the respective center lines CL1, CL3 and CL2 and sense registration marks 400, 400' and 400 on webs W1, W3 and W2, respectively.

Figure 6:
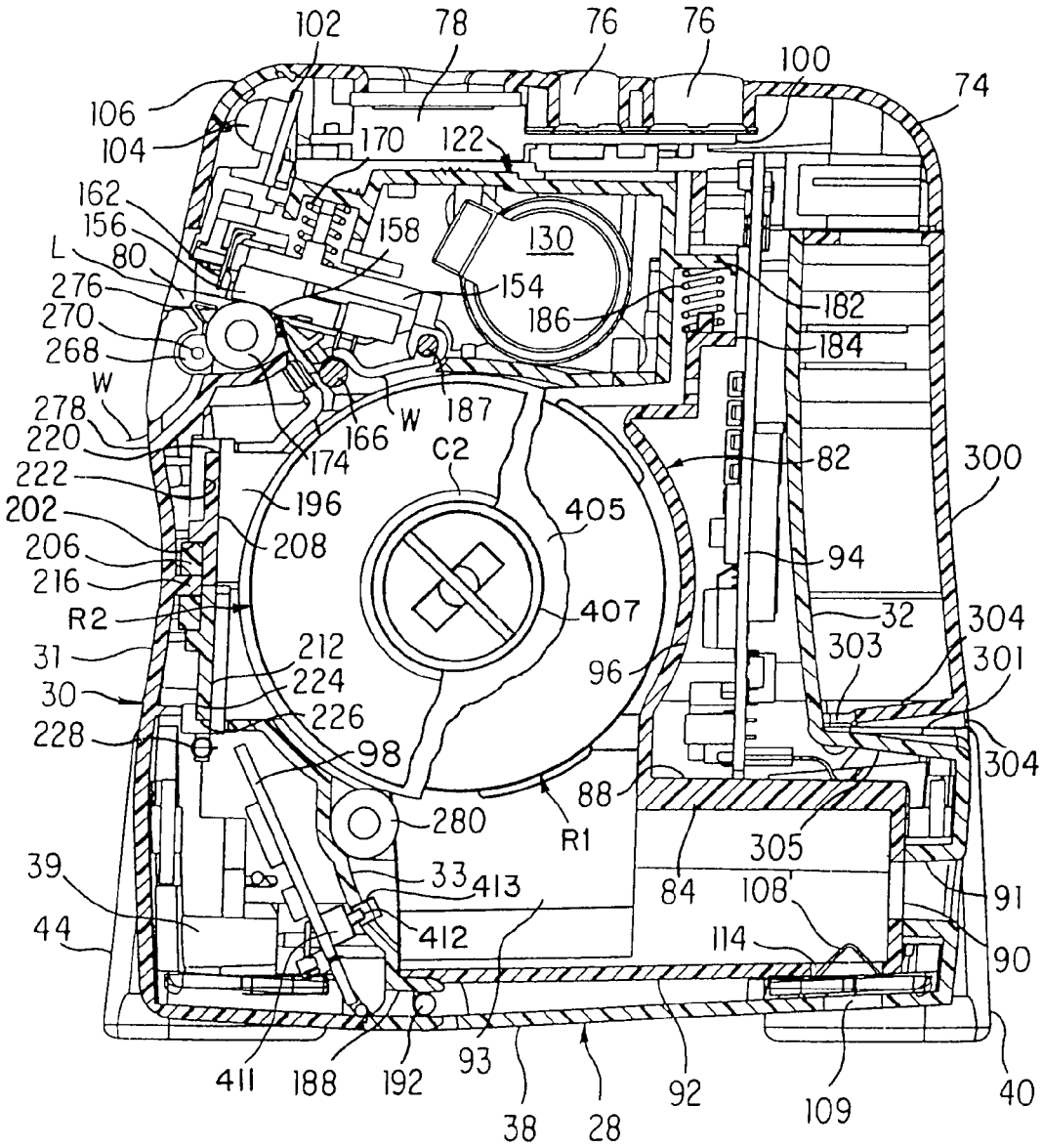
FIG. 6 is a sectional elevational view through the printer.

As shown in FIG. 6, a board 98 mounts a three-position switch 411 having a button 412 manually movable to any one of three positions namely, left, right or center. The button 412 is operable through an elongate slot 413 in the inner door panel 33. FIG. 16 shows the button 412 in a position at the left side of the slot 413, wherein the registration marks 400 on the label web W2 of roll R2 can be sensed by the sensor 410. If the button 412 is moved to the other or right of the slot 413, the marks 400 on the label web W1 of the roll R1 can be sensed by the sensor 408. If the button 412 is moved to the center of the slot 413, the marks 400' in the label web W3 of the roll R3 can be sensed by the sensor 409. Therefore, the printer 26 can selectively print on webs W1, W2 or W3 depending on the position of the button 412 of the three position switch 411.

If more than two rolls are desired to be mounted in the printer 26 at any one time, it is apparent that, by providing additional mark sensors and an appropriate switch, any one of such rolls can be selected for printing if desired.

Figure 5:
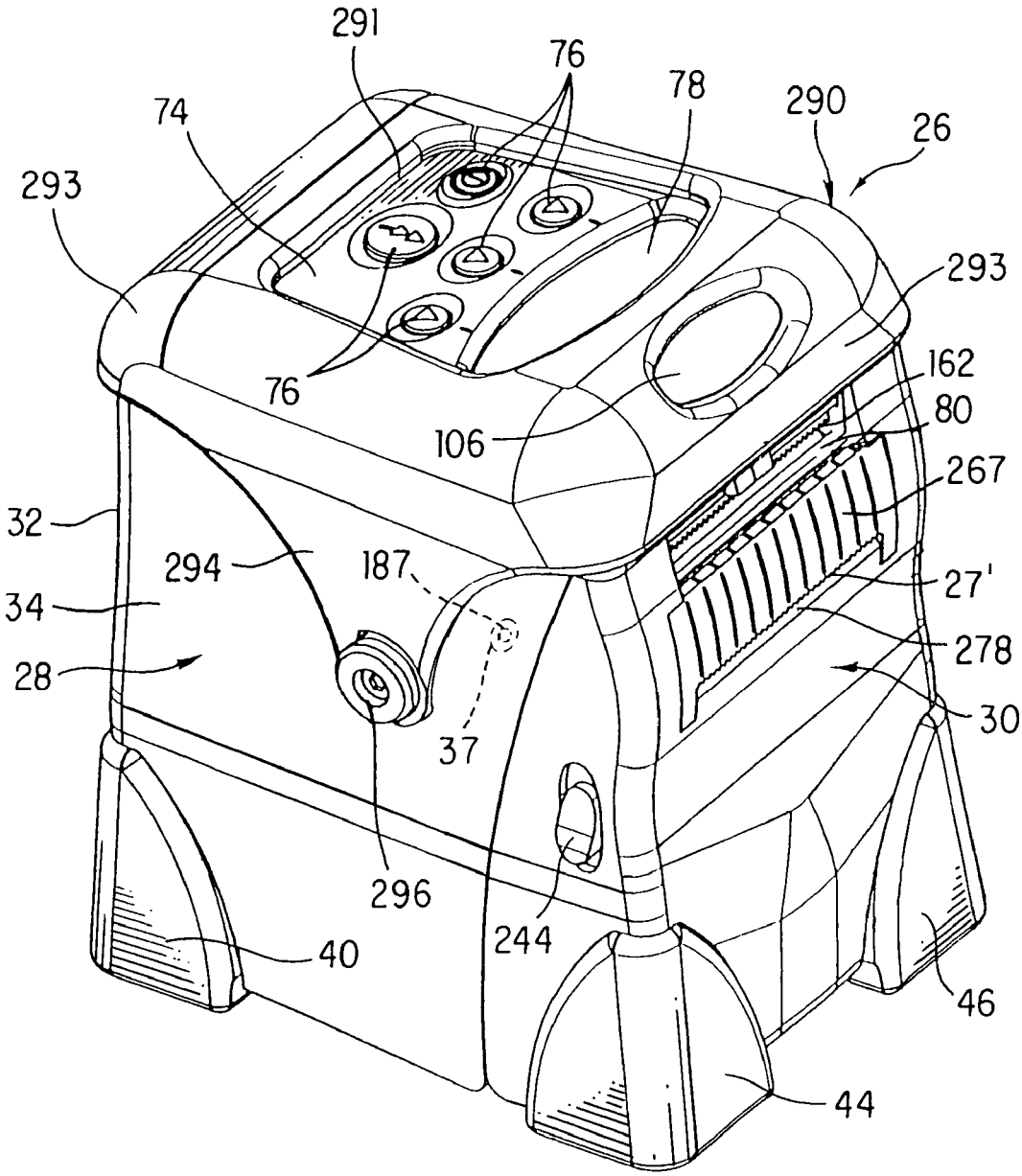
FIG. 5 is a perspective view of a printer in accordance with the invention.
Figure 14:
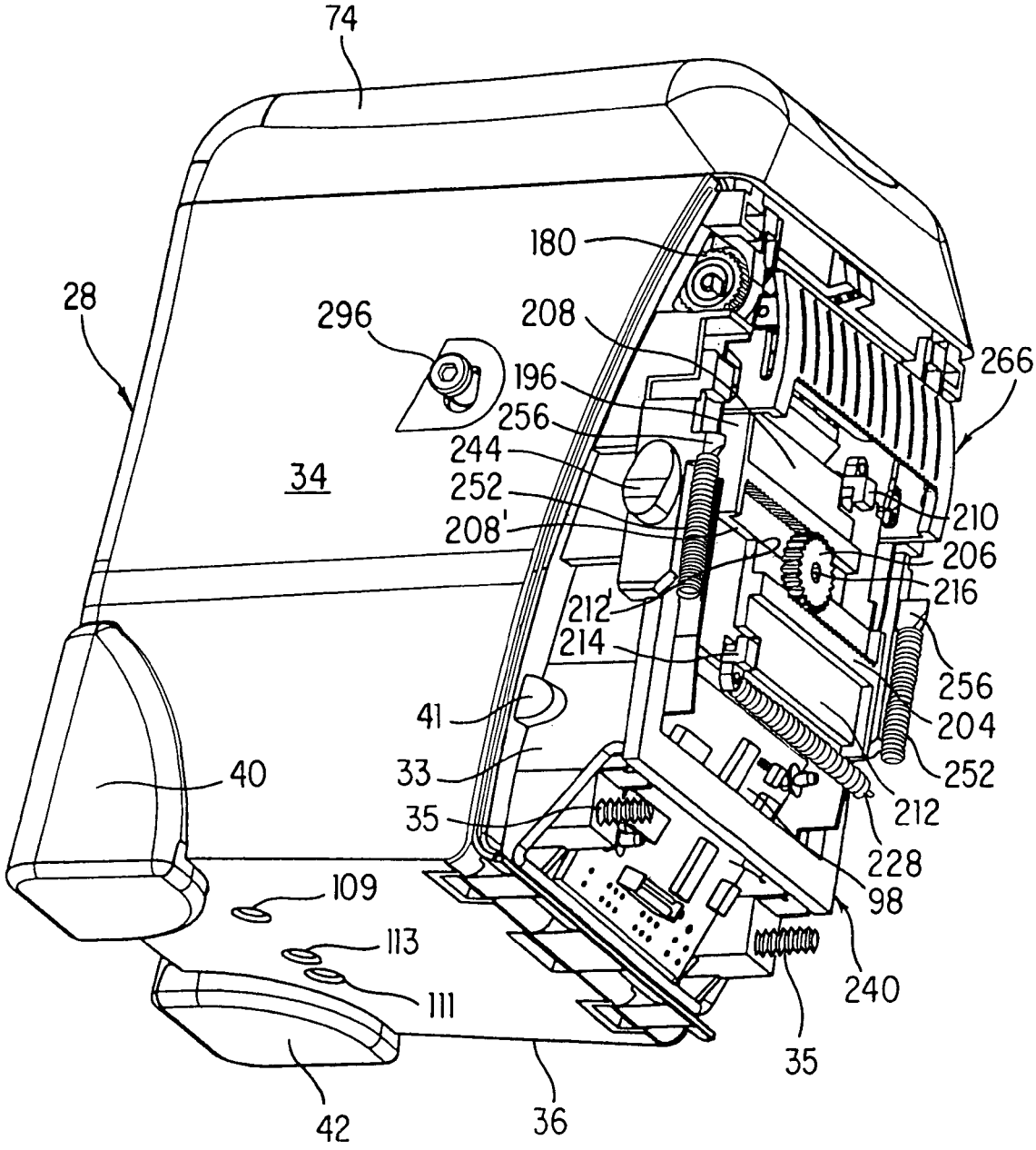
FIG. 14 is a perspective view showing the front and the right side of the printer with the outer door panel removed.
Figure 15:
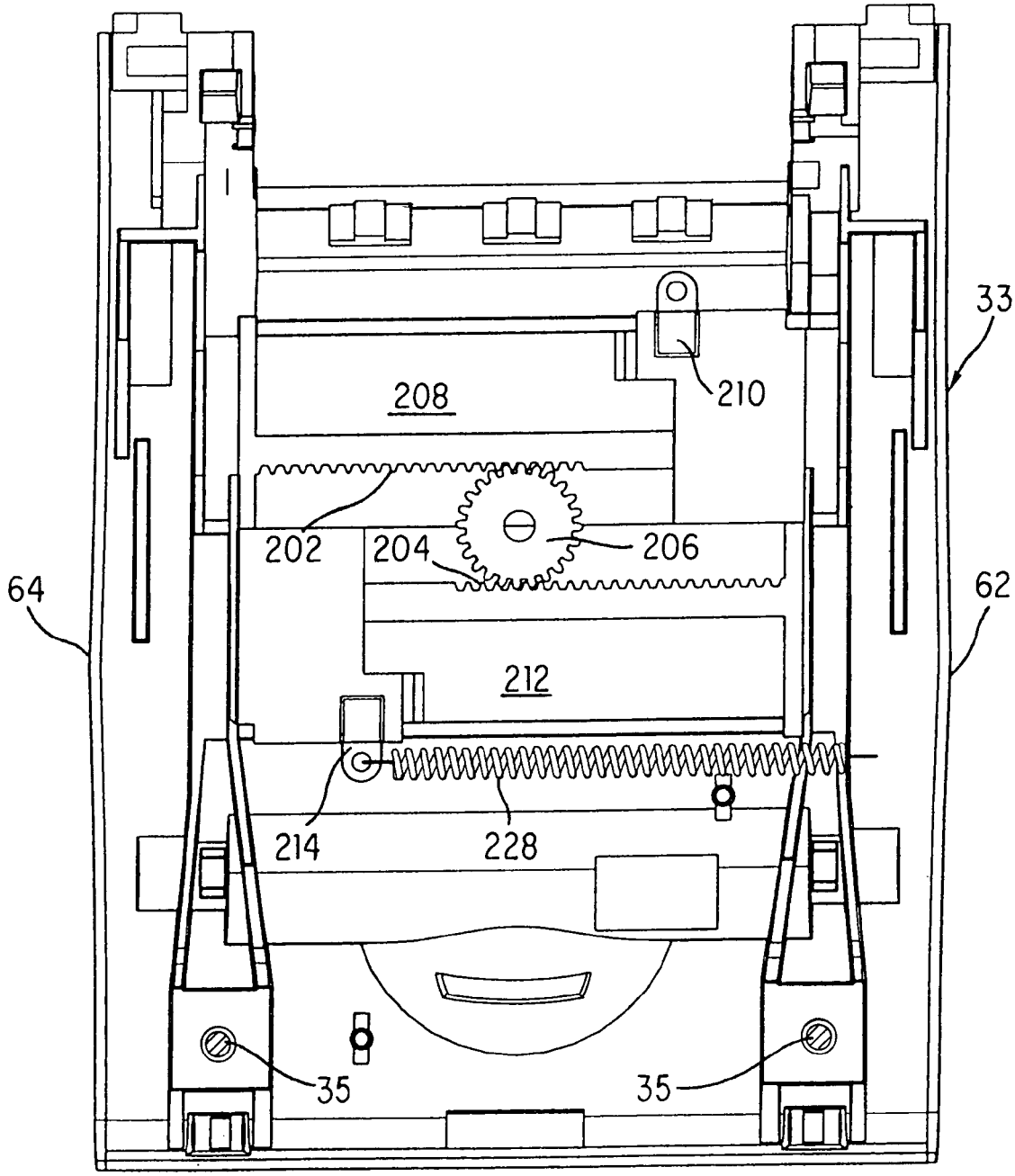
FIG. 15 is a front elevational view of the inner door panel with the outer door panel removed.
Figure 20:
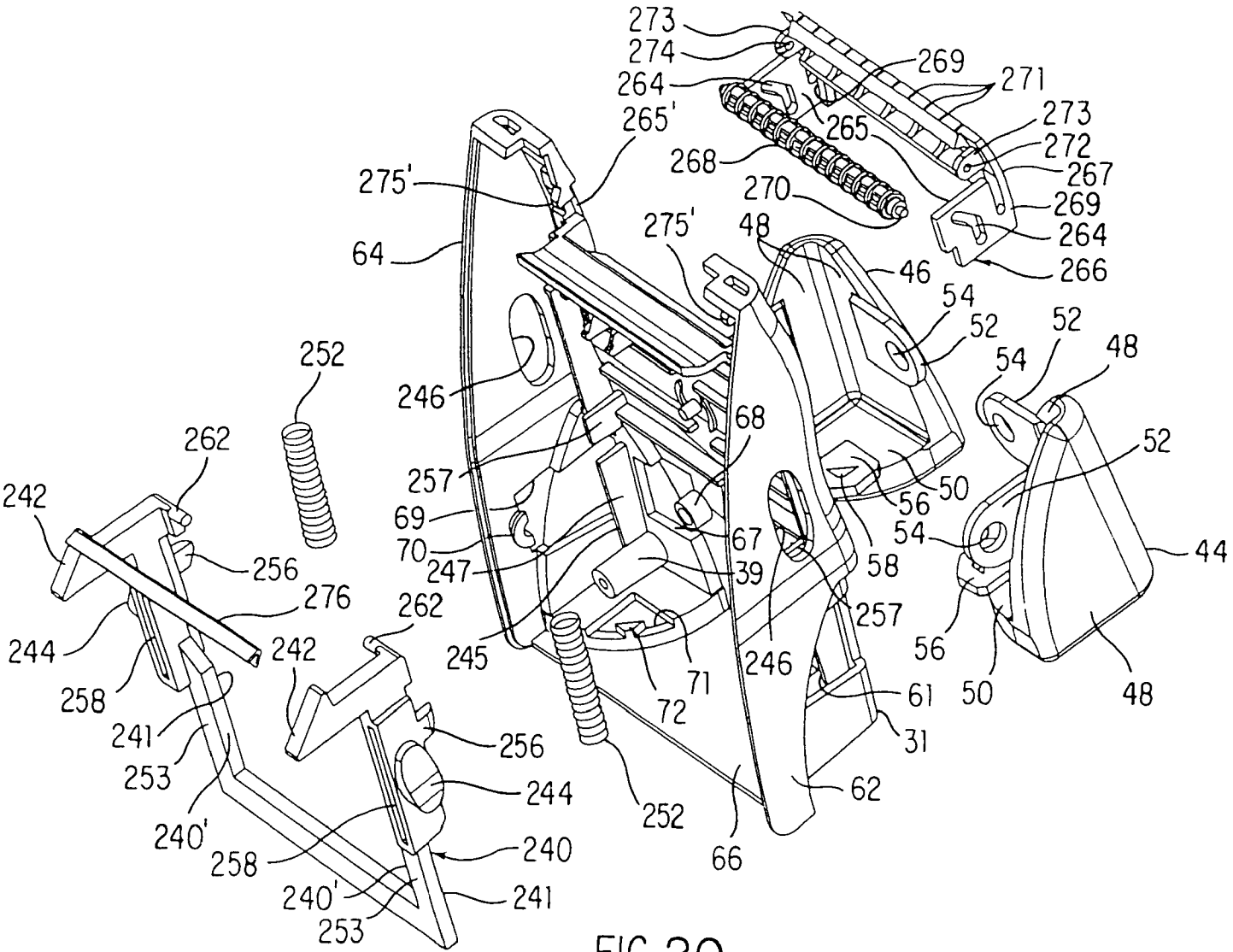
FIG. 20 is an exploded perspective view of the outer door panel, the latch, the pressure roll and carrier and two of the pads.
Figure 21:
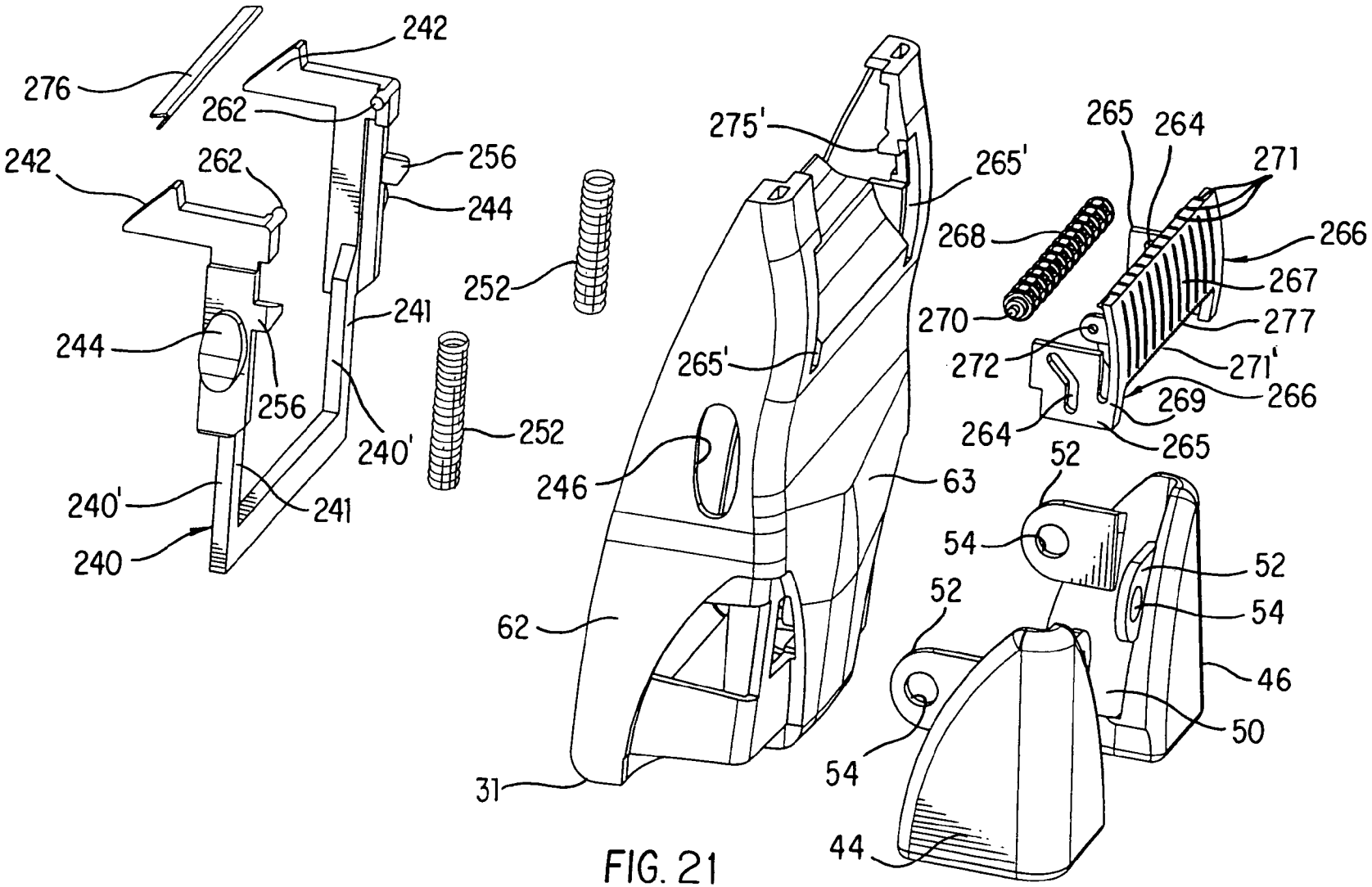
FIG. 21 is an exploded perspective view of the components shown in FIG. 20.

With reference to FIG. 5, there is shown the printer generally indicated at 26 having a portable housing generally indicated at 28 and a subassembly in the form of a front door 30. The housing 28 has a rear wall 32, a right side wall 34, a left side wall 36 (FIG. 14) and a bottom panel 38. The walls 32, 34 and 36 and the bottom panel 38 are integrally molded and form the frame of the printer 26. The printer 26 has four spaced, identical, one-piece, resilient, elastomeric pads 40, 42, 44 and 46 which serve as feet to support the printer 26 on a flat surface but they also serve to help protect the printer 26 from damage in the event the printer 26 is dropped. The pads 40 and 42 are secured to the lower corners of the rear portion of the housing 28 and the pads 44 and 46 are secured to an outer panel 31 of the door 30. The outer door panel 31 and an inner door panel 33 are secured to each other by screws 35 passing through holes 37 and threadably received in bosses 39. Each pad 40, 42, 44 and 46 has a pair of joined triangular-shaped side panels 48 (FIG. 20) extending at right angles to each other and joined to a bottom panel 50. The side panels 48 have tabs 52 which extend at right angles to each other. The tabs 52 have round holes 54. The bottom panel 50 has a tab 56 with a triangular-shaped hole 58. The front door panel 31 right and left side sections 62 and 64 and a bottom section 66. The tabs 52 of the pad 44 for example extend through openings 61 and 63 and the associated tab 56 extends through an opening 65. Tabs 52 of the pad 46 extend through openings 67 and 69 and the associated tab 56 extends through an opening 71. The pads 40 and 42 are connected to the housing 28 identically to the pads 44 and 46. Bosses 41, only one of which is shown in FIG. 14, prevent ears 52 from coming off projections 70. The sections 62, 64 and 66 have studs or projections 68, 70 and 72 received in the holes 54 and 58.

The housing 28 has a top cover 74 secured to the housing 28. The top cover has keys 76, a display 78 and a window 106 for infra-red data transmission. The front door 30 has an exit opening 80.

Figure 8:
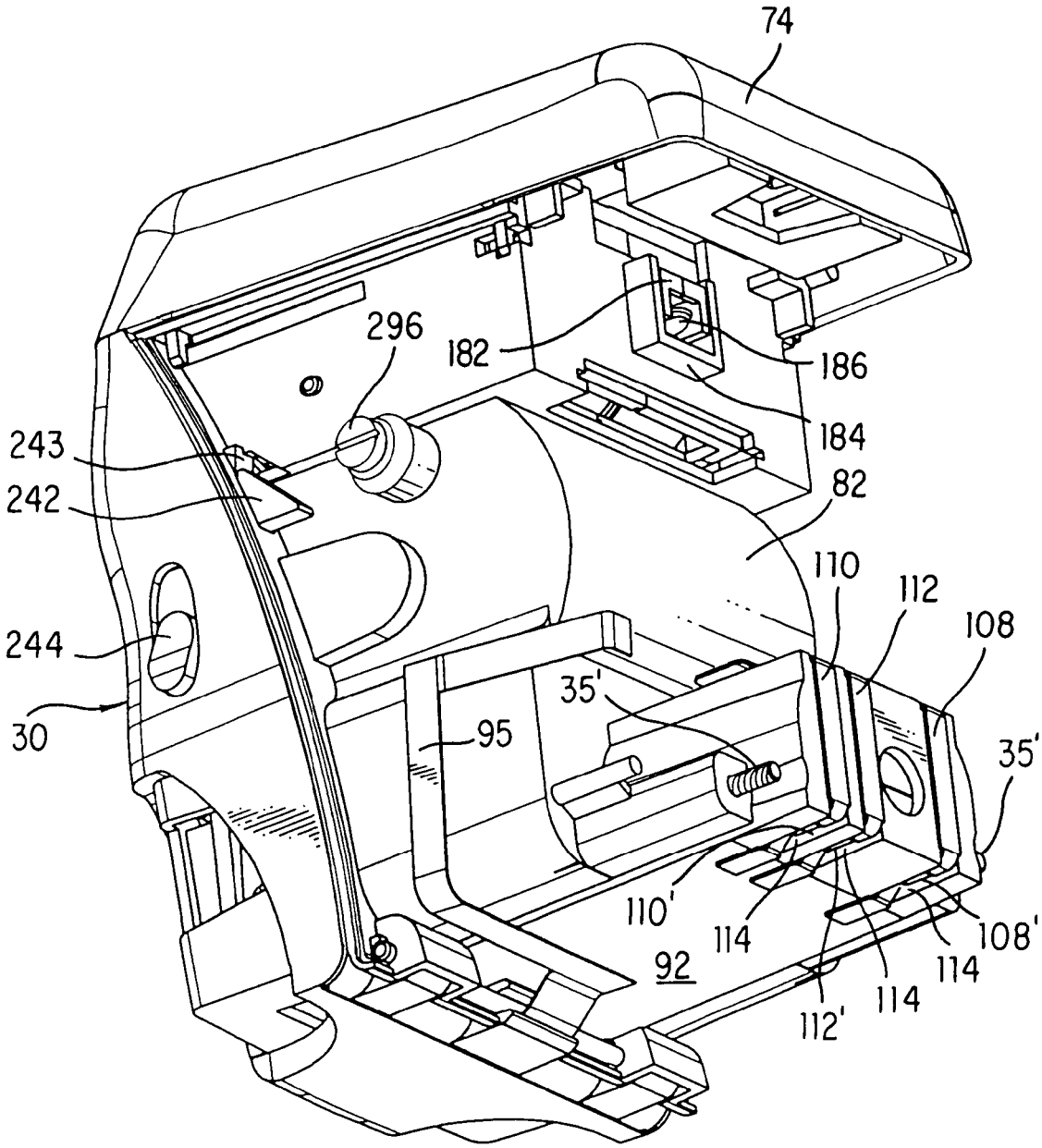
FIG. 8 is a perspective view similar to FIG. 7 but showing both the housing and one of the printed circuit boards removed.
Figure 9:
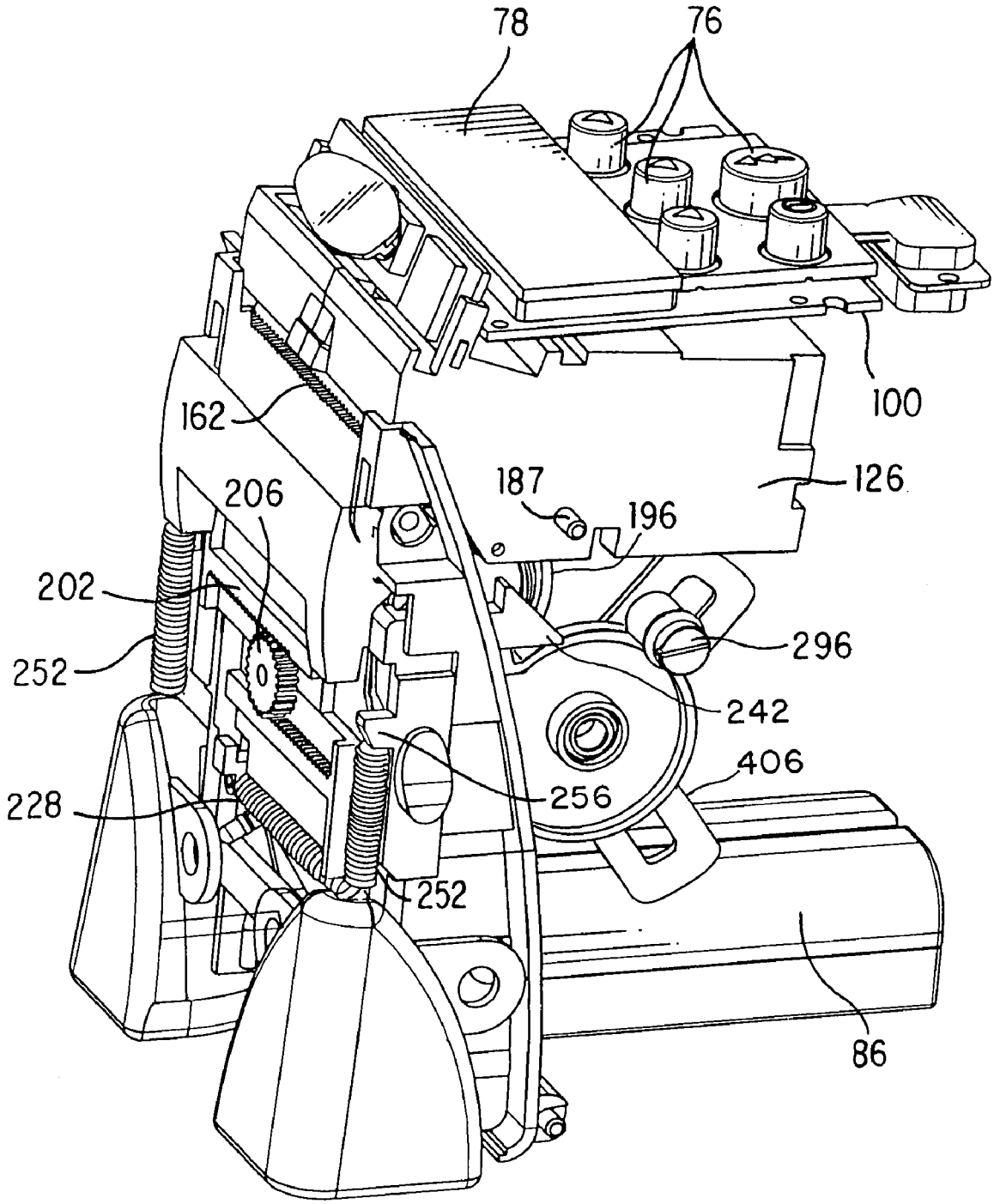
FIG. 9 is a perspective view showing the front and the left side of the printer with certain parts removed.
Figure 10:
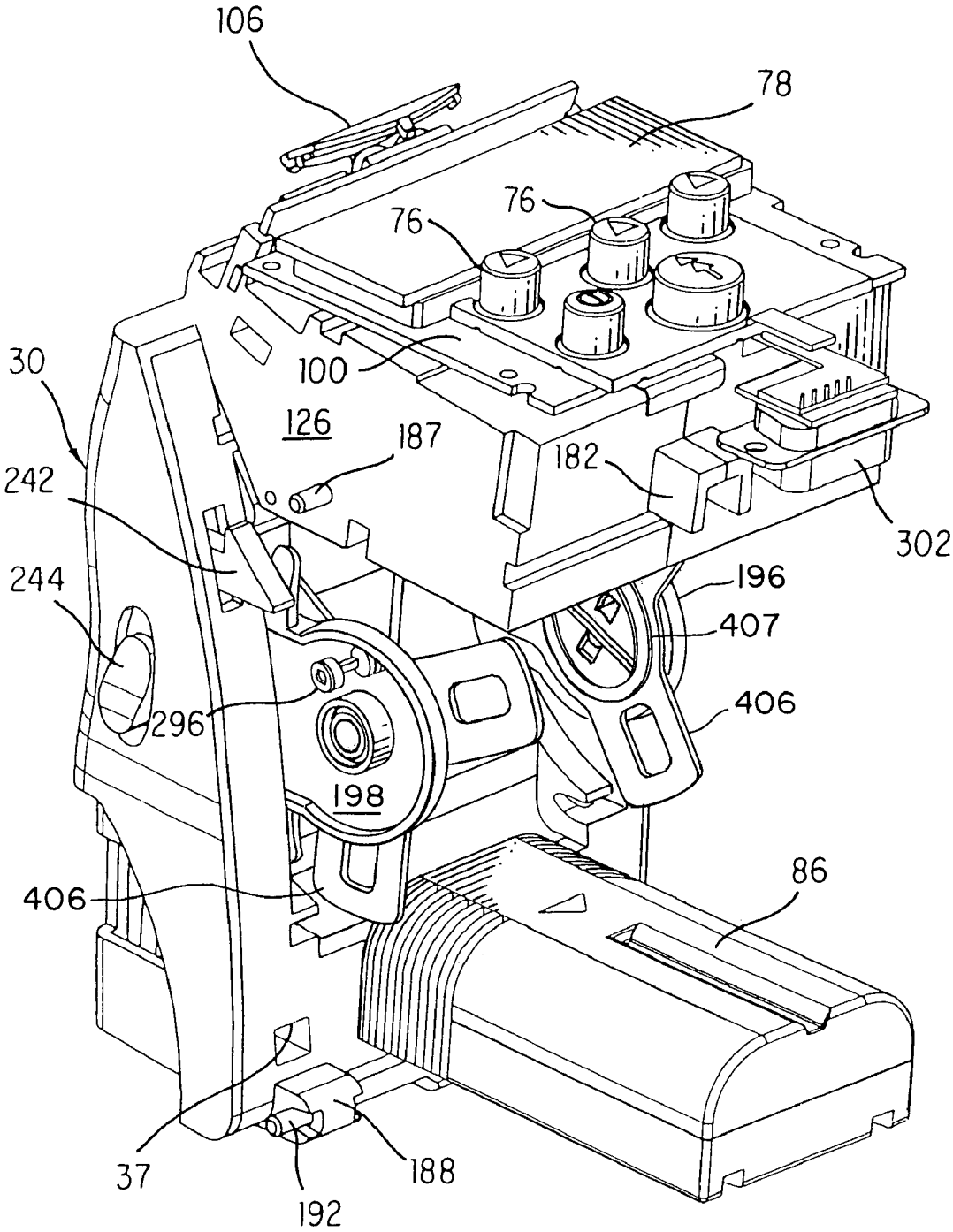
FIG. 10 is a perspective view of the printer with the housing, the upstanding circuit board, the battery compartment and with other parts removed.
Figure 13:
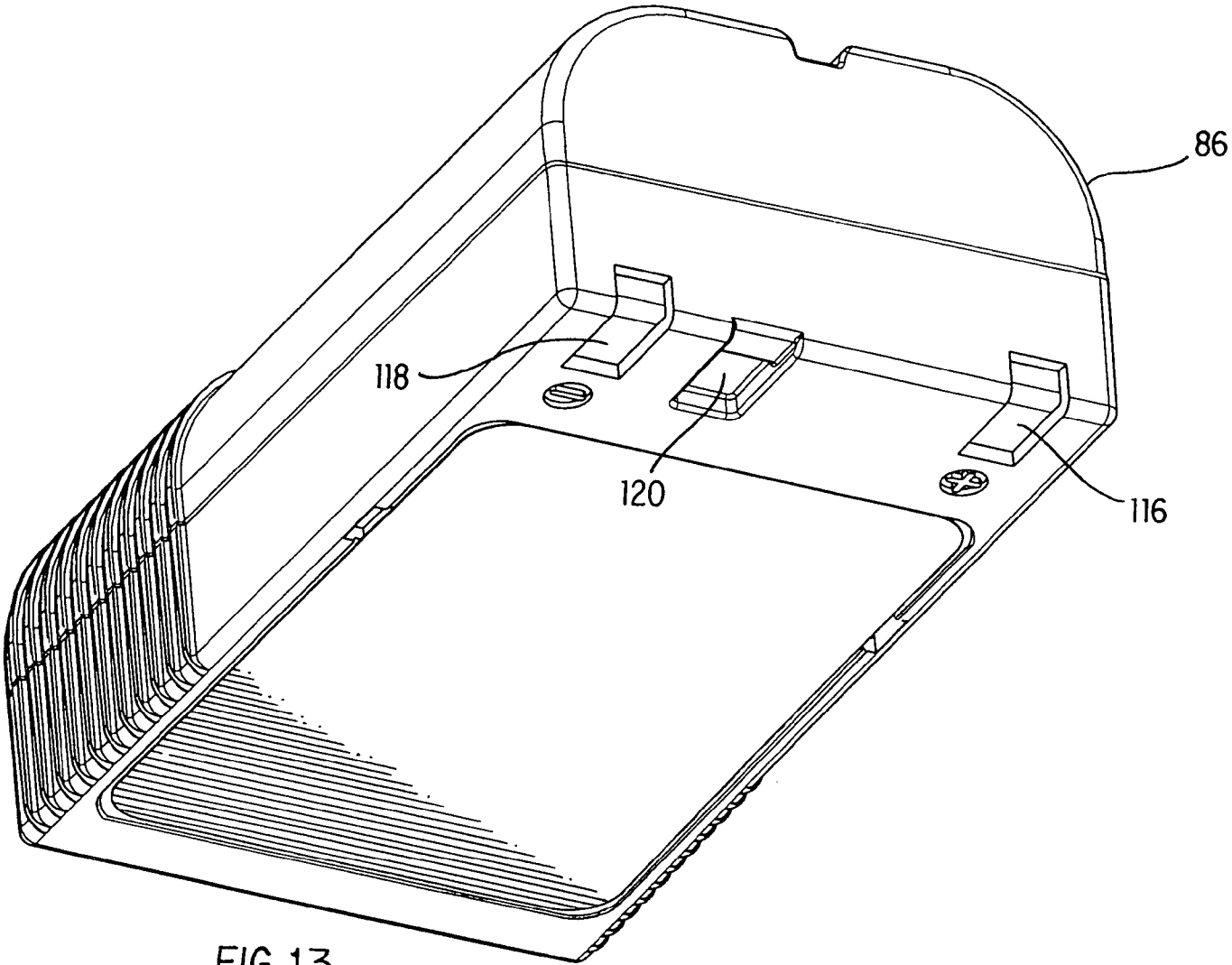
FIG. 13 is a perspective view of the battery used in the printer.

The housing 28 contains a subframe or inner housing generally indicated at 82 (FIG. 6). The subframe 82 is secured to the housing 28 by screws 35' (FIG. 8) received in bosses 39' on the rear wall 32. The subframe 82 has space in a compartment 84 for receiving a battery 86 (FIGS. 9, 10 and 13) for powering the printer 26. The compartment 84 has an upper wall 88, a rear wall 90 and a floor or bottom wall 92. The compartment 84 has an opening 93 into which the battery 86 can be inserted and removed when the door 30 is open. A vertically extending or upstanding printed circuit board 94 is secured in place between the rear wall 32 and a rear wall 96 of the subframe 82. The printed circuit board 94 is electrically connected to the battery 86, to the board 98 mounted on the door 30, a printed circuit board 100 for the keys 76 and the display 78, and a printed circuit board 102 for an infra-red receiver. The printed circuit board 102 mount an infra-red sensor 104 aligned with the window 106 on the cover 74. The printed circuit board 98 is connected to the printed circuit board 94 by a flexible connector 95.

Flat, flexible, resilient conductors 108, 110 and 112 having U-shaped configurations and being connected to printed circuit board 94 pass about walls 88, 90 and 92. The conductors 108, 110 and 112 are sandwiched between the wall 90 and a tubular part 91 of the rear wall 32. The conductors 108, 110 and 112 have portions bent into inverted V-shapes which serve as contacts 108', 110' and 112' which extend through three holes 114 (FIG. 6). Alternatively one large hole could be used if desired. The battery 86 (FIG. 13) has contacts 116 and 118 and a recess 120. The contacts 116 and 118 are cooperable with respective contacts 108' and 110'. The contact 112' detents into the recess 120 to releasably hold the battery 86 in position. As shown in FIG. 14, the bottom panel 38 has three spaced holes 109, 111 and 113 aligned with respective contacts 108', 110' and 112'. The holes 109, 111 and 113 enable contacts (not shown) of a battery charger (not shown) to make contact with contacts 109', 110' and 112'. The printer electronics of the printer 26 are disabled when the battery charger contacts contact the contact 112' thereby preventing powering of the printer 26 by means of the battery charger.

Figure 11:
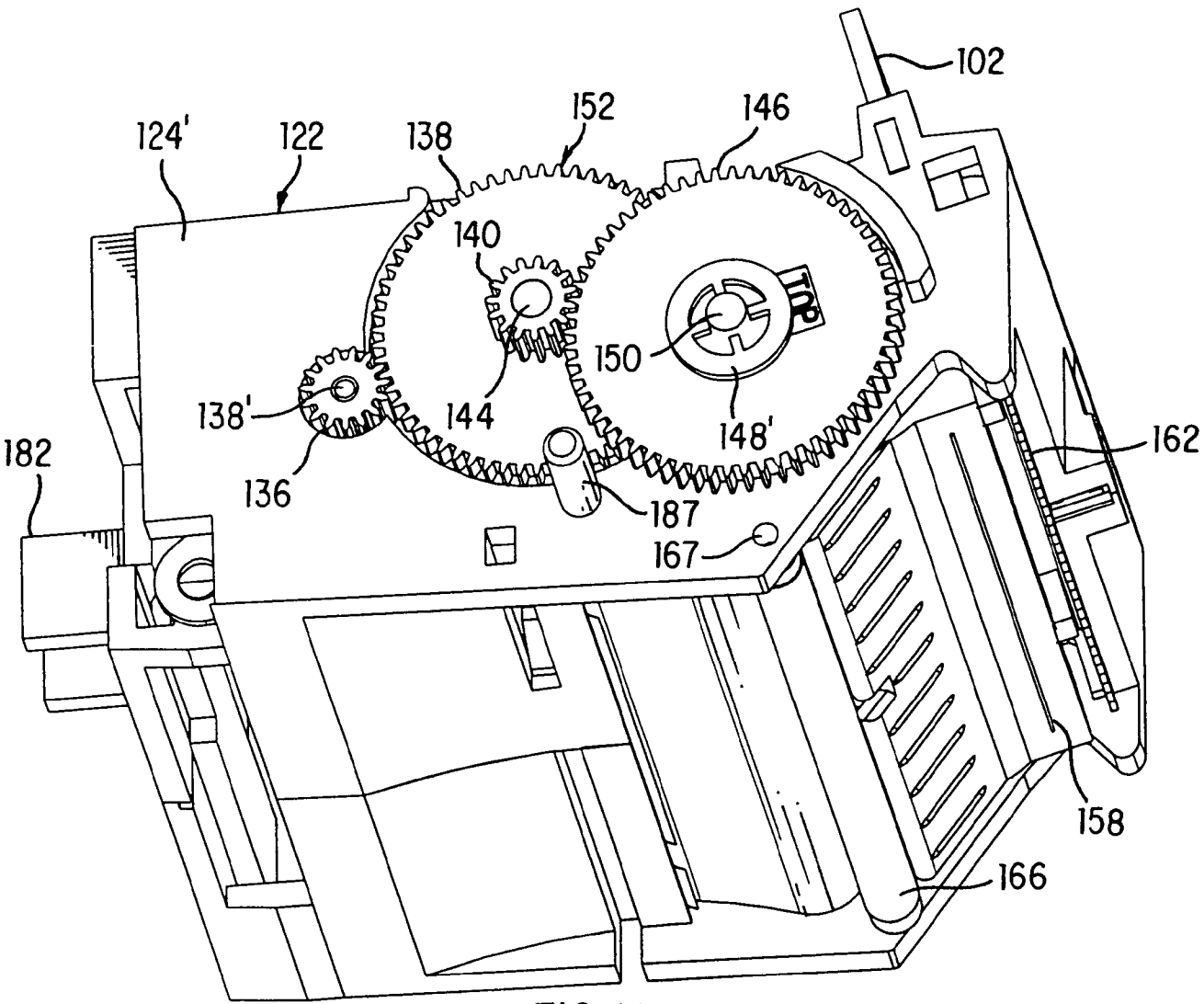
FIG. 11 is a perspective view of the module or subassembly for mounting the motor, gearing, the print head.
Figure 12:
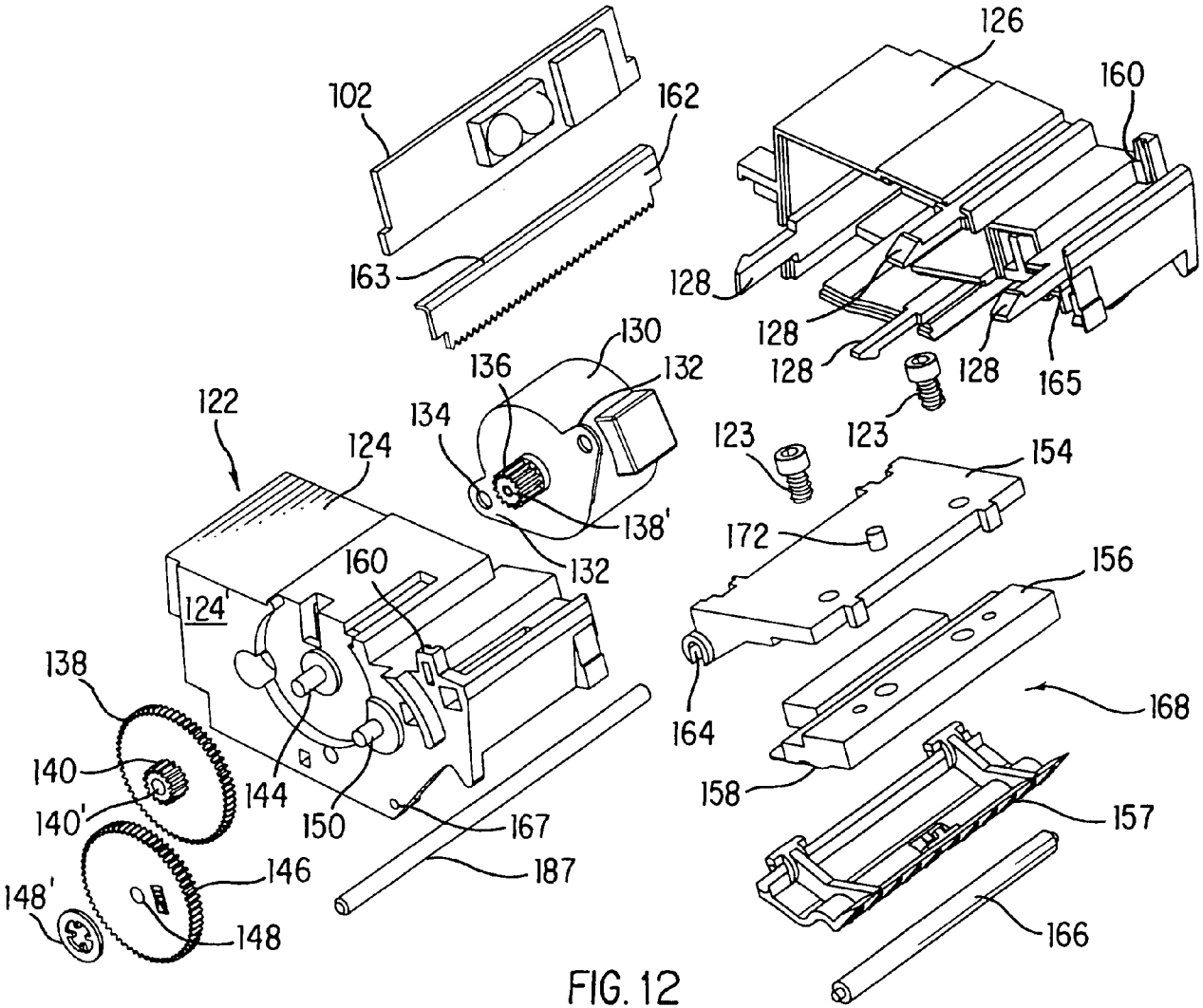
FIG. 12 is an exploded perspective view of the subassembly which is shown assembled in FIG. 11.

With reference to FIGS. 11 and 12, there is shown a subassembly or module generally indicated at 122 which is pivotally mounted in the housing 28. The subassembly 122 is comprised of a mirror image pair of shell-shaped sections 124 and 126 releasably snap-fitted to each other by prongs 128 on the section 126 detented in the section 124. An electric motor 130 has spaced tabs 132 with holes 134. A sleeve 135 on the motor 130 locates the motor 130 in a hole 135' in wall 124'. A gear 136 on motor shaft 138' meshes with a gear 138, and a gear 140 integral with the gear 138 meshes with a gear 146. The gears 136, 138, 140 and 146 comprise gearing generally indicated at 152. The gears 138 and 140 have a common through-hole 140'. A stationary pin 144 on wall 124' of the section 124 is received in the hole 140'. A stationary pin 150 on the wall 124' is received in a hole 148 in the gear 146 and a clip 148' holds the gear 146 on pin 150. Secured to the front underside of the subassembly 122 by a pin or rod 187 is a mounting plate 154. A heat sink 156 is secured to the underside of the plate 154 by screws 123. The thermal print head 158 is secured to the underside of the heat sink 156. Ends of the printed circuit board 102 are secured in recesses 160 in the sections 124 and 126. A tear edge 162 has a flange 163 supported on a shelf 165.

Figure 18:
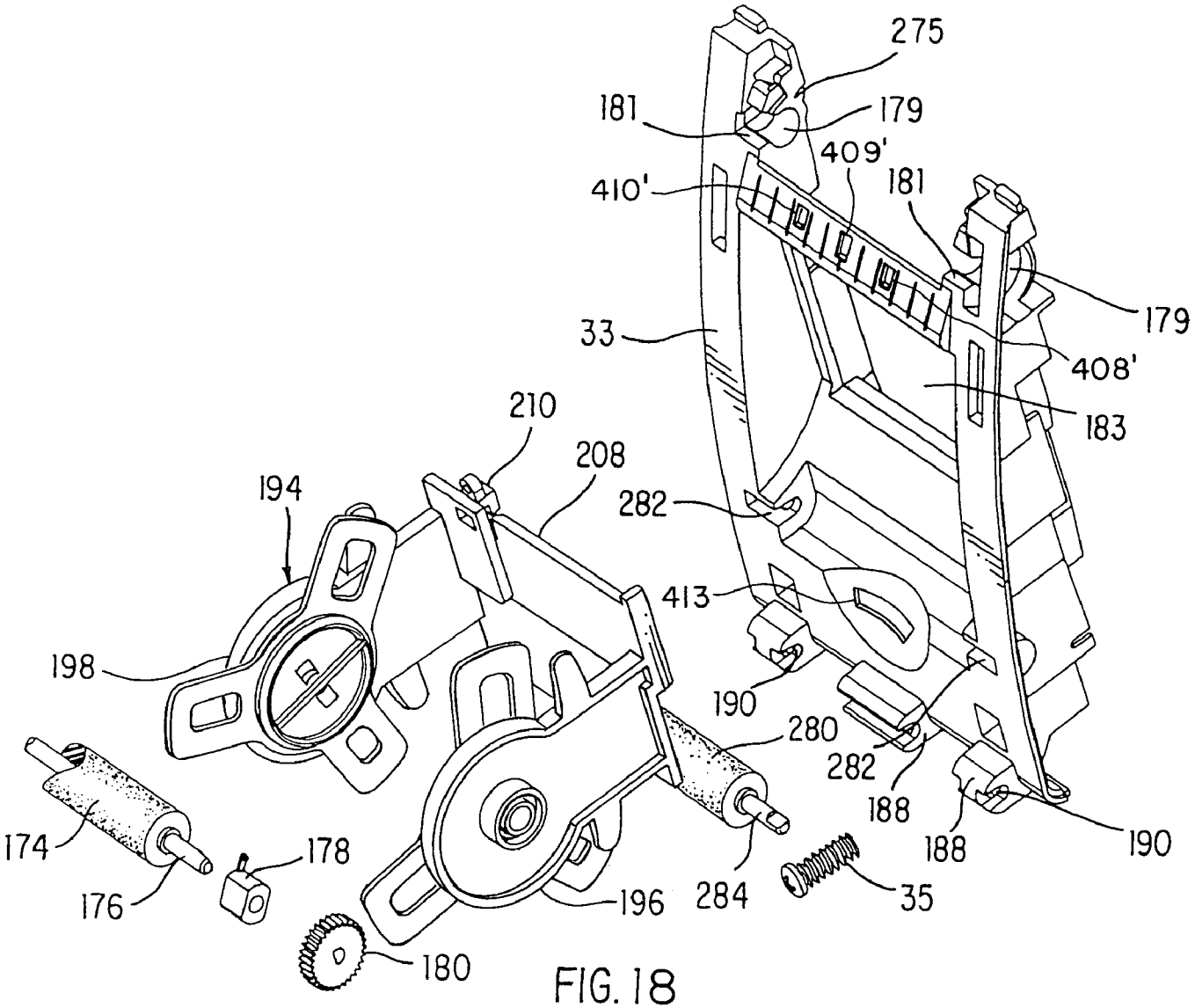
FIG. 18 is an exploded perspective view of the supply roll holder and the inner portion of the door.

The plate 154 has an inverted U-shaped opening 164 for receiving a rod 187. A rod 166 is mounted in axially spaced holes 167 in the sections 124 and 126. A print head assembly generally indicated at 168 includes the plate 154, the heat sink 156, the print head 158 and a guide 157 pivotally mounted on the rod 187. A compression spring 170 (FIG. 6) acts on inner surfaces of the sections 124 and 126 and the plate 154. The plate 154 has a pin 172 which helps retain the spring 170 in position. The spring 170 urges the print head 158 into printing cooperation with the operative platen roll 174. The platen roll 174 (FIG. 16) has a shaft 176 mounted in identical bearing blocks 178 (FIG. 18). A gear 180 secured to the shaft 176 meshes with the gear 146 when the door 30 is closed. Thus, the motor 130 drives the gearing 152 which in turn drives the gear 180 and the platen roll 174.

The subassembly 122 has an inverted U-shaped pocket 182 (FIGS. 6 and 11) opposed to a U-shaped pocket 184. The pockets 182 and 184 mount a compression spring 186. The subassembly 122 is pivotally mounted on the rod or pivot 187 and is urged by the spring 186 toward a counter-clockwise position (FIG. 6). The pivot 187 is mounted in opposed side walls of the subframe 82 as indicated at 37. Accordingly, the print head 158 is urged toward the platen roll 174 by the spring 186.

The inner panel 33 of the door 30 has bosses 188 (FIG. 18) with aligned holes 190 for receiving a shaft or pivot 192 (FIG. 6) which pivotally mounts the door 30 for movement between closed and open positions. The inner panel 33 mounts a label roll holder generally indicated at 194 in opening 183.

Figure 24:
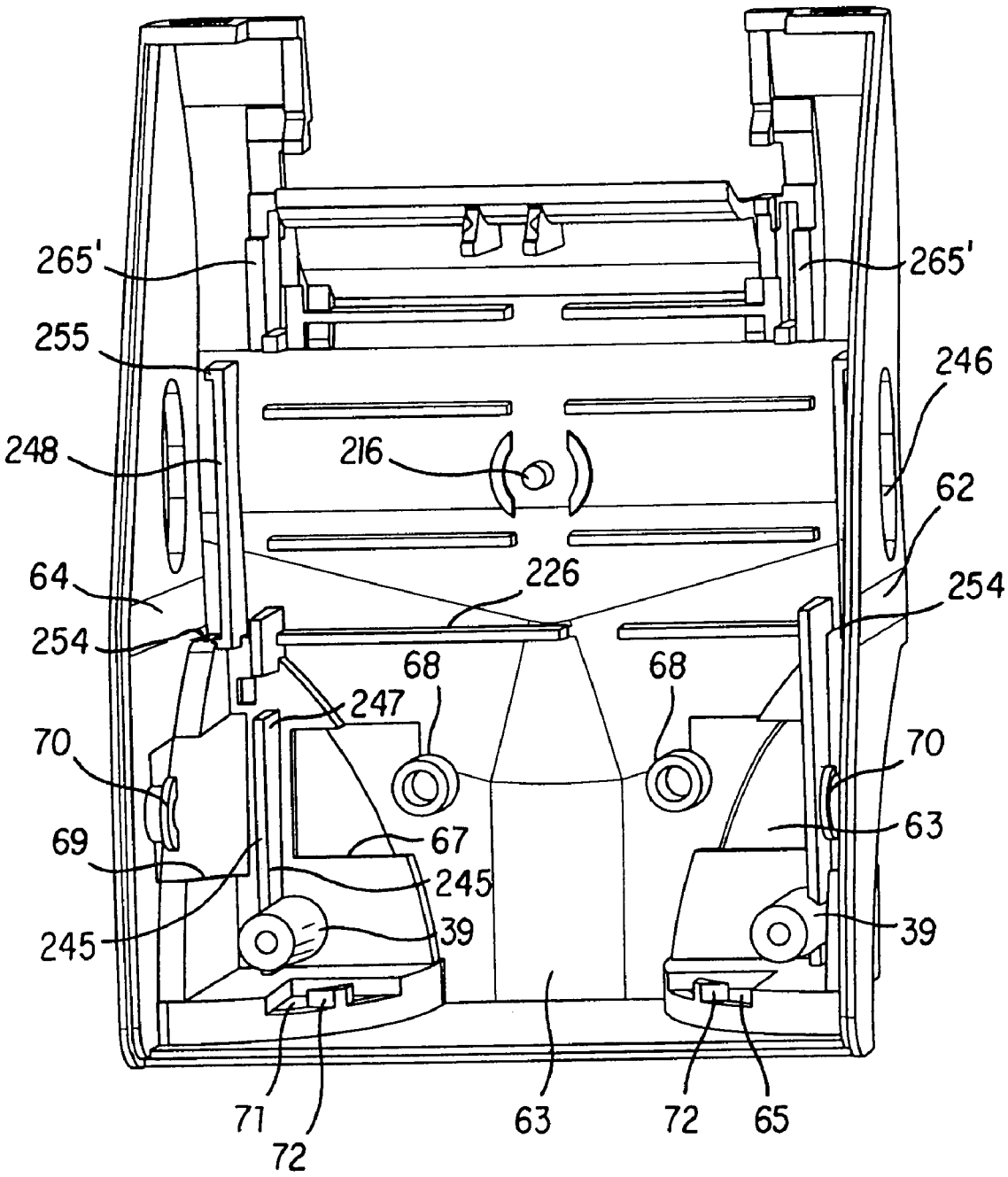
FIG. 24 is a perspective view of inside of the outer door panel.

There is a laterally extending rack 202 on the holder member 196 and a laterally extending rack 204 on the holder member 198. The racks 202 and 204 mesh with a pinion 206. The rack 202 is integral with a lateral section 208 guided by a guide 210 when the lateral section 208 moves to the right (FIG. 14). The rack 204 is integral with a lateral section 212. The lateral section 212 is guided by a guide 214 when the section 212 moves to the left (FIG. 14). The upper surface 212' of the section 212 is guided by the lower surface 208' of the section 208. The pinion 206 is rotatably mounted on a fixed pin 216 (FIGS. 6 and 24). The upper surface of the section 208 is guided by surfaces 220 and 222 (FIG. 6). The section 212 is guided by surfaces 224 and 226. A tension spring 228 is secured at one end to the guide 214 and at its other in a hole 229 in the outer panel 31. Thus, when no supply roll R is mounted on the hubs 406, the spring 228 urges the holder members 196 and 198 toward each other until the ends of sections 208 and 212 contact ribs 217. In order to insert a supply roll R onto the hubs 406, the holder members 196 and 198 are manually spread apart until the hubs 200 can enter the central hole 230 in the roll R.

The outer panel 31 slidably mounts a U-shaped one-piece slide generally indicated at 240. The slide 240 includes a pair of latches 242. Latches 242 latch with members 243 on opposite sides of the subframe 82 to hold the door 30 closed. The slide carrier 240 has a pair of finger-engageable buttons 244 received with clearance in slots 246 in the side portions 62 and 64. The slide 240 is guided by guides 257 received in slots 258 in the slide 240. Rear surfaces 241 of legs 240' are guided by end edges 245 of ribs 247 (FIG. 24). End edges 249 (FIG. 19) of ribs 251 guide front faces 253 of the legs 240' of the slide 240. Accordingly, the slide 240 is guided for vertical movement by and between the inner door panel 33 and the outer door panel 31. The slide 240 is urged upwardly by a pair of parallel compression springs 252 acting on surfaces 254 on the door panel 33 and on lugs 256 on the slide 240. The springs 252 are received in spaces between ribs 248 and respective side portions 62 and 64. The ribs 248 have integral stops 255 for the lugs 256.

Figure 23:
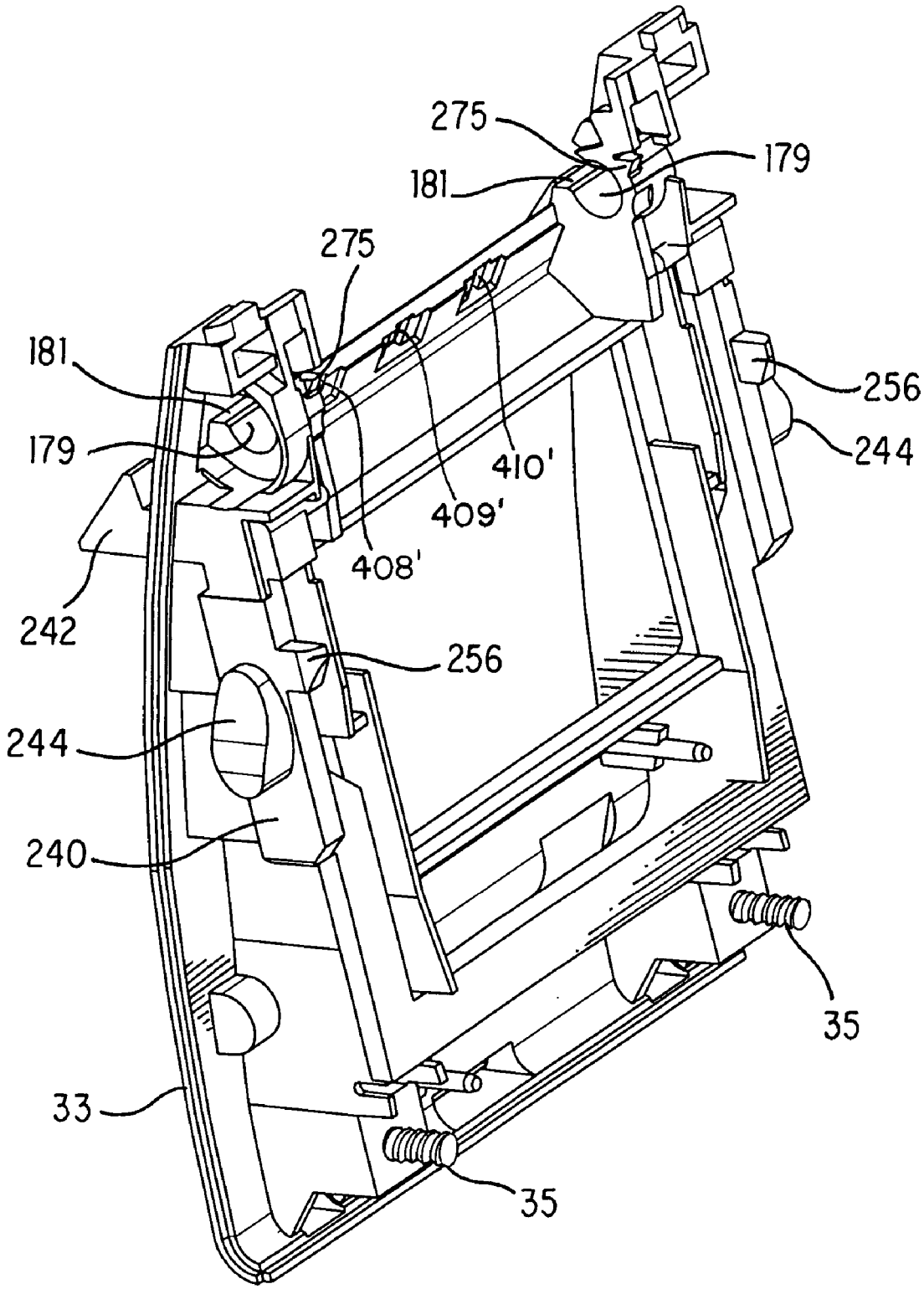

The slide 240 has a pair of opposed pins 262 (FIG. 23) received in contoured slots 264 in horizontally slidable slide blocks 265 of a carrier 266. The slide blocks 265 are slidable in slots 265'. A pressure roll 268 has a shaft 270 the end portions of which are received in holes 272 and 274 in tabs 273 on a cantilevered section or leaf spring 267 of the carrier 266. The leaf spring 267 is flexed to resiliently urge the pressure roll 174 against the platen roll 174 to assure that the platen roll 174 advances the web W. The section 267 is cantilevered to the slide blocks 265 as indicated at 269. The top surface of the section 267 has spaced label-supporting ridges which support a delaminated label L as shown in FIG. 6. The lower edge of the section 267 has a serrated tear edge 271' for severing the spent carrier web W. As the slide 240 is moved downwardly against the action of the springs 252, the carrier 266 is cammed out of contact with the platen roll 174 to a position spaced from the platen roll 174.

The roll R can be a linered supply web such as a web W with labels L releasably adhered thereto by pressure sensitive adhesive as shown in FIG. 6. As the platen roll 174 rotates, the carrier web W (FIG. 6) is drawn about a delaminator 276. The delaminator 276 is a bent metal plate in the shape of an acute angle or a "V" received on a V-shaped ledge 275 on the inner door panel 33. Abutments 275' on the outer door panel 31 hold the delaminator 276 in place. Alternatively, the delaminator can be a peel roller (not shown). After passing about the delaminator 276, the spent carrier web W passes between the platen roll 174 and the pressure roll 268 and exits the printer 26 through an opening 278. In the event the roll R is composed of linerless adhesive-backed label material or tag material, such a web passes between the print head 158 and the platen roll 174 and simply exits through the opening 80. In the case of linerless adhesive-backed label material, the adhesive side or underside of the label material web W contacts the platen roll 174 and thus the surface of the platen roll 174 is provided with a non-stick surface such a commonly-used siliconized coating on the platen roll or the platen roll itself can be comprised of silicone rubber which does not adhere well to the adhesive.

The door 30 can pivot about 100° between its latched position and an open position. The space within the subframe or inner housing 82 can receive the roll R. When the door 30 is open, a battery 86 can be easily inserted into or removed from the compartment 84 through opening 94 (FIG. 6). A roll R of labels L or tags can be easily inserted onto the holder 194, and the print head 158 can be easily cleaned. As shown in FIGS. 6, 10, 16 through 19 and 22, the printer 26 is provided with C-shaped snap sockets 282 for receiving end portions of a shaft 284 of a spare platen roll 280. In the event the operative platen roll 158 needs to be changed, the platen roll 174 can be removed and bearing blocks 178 and the gear 180 from the platen roll 174 can be applied to the shaft 284. The roll 280 with the bearing blocks 178 and the gear 180 thereon can be repositioned into the operative portion formerly occupied by the platen roll 173 and the bearing blocks 178. As shown for example in FIG. 23, the inner door panel 33 has aligned C-shaped pockets 179 for receiving the bearing blocks 178. By rotating the bearing blocks 178, the bearing blocks 178 can be inserted into or removed from the pockets 179 through narrow openings 181. In the event linerless adhesive-backed label material is to be used, the platen 280 can likewise have a non-stick or silicone coating such as silicone or it can be comprised of siliconized rubber.

Figure 7:
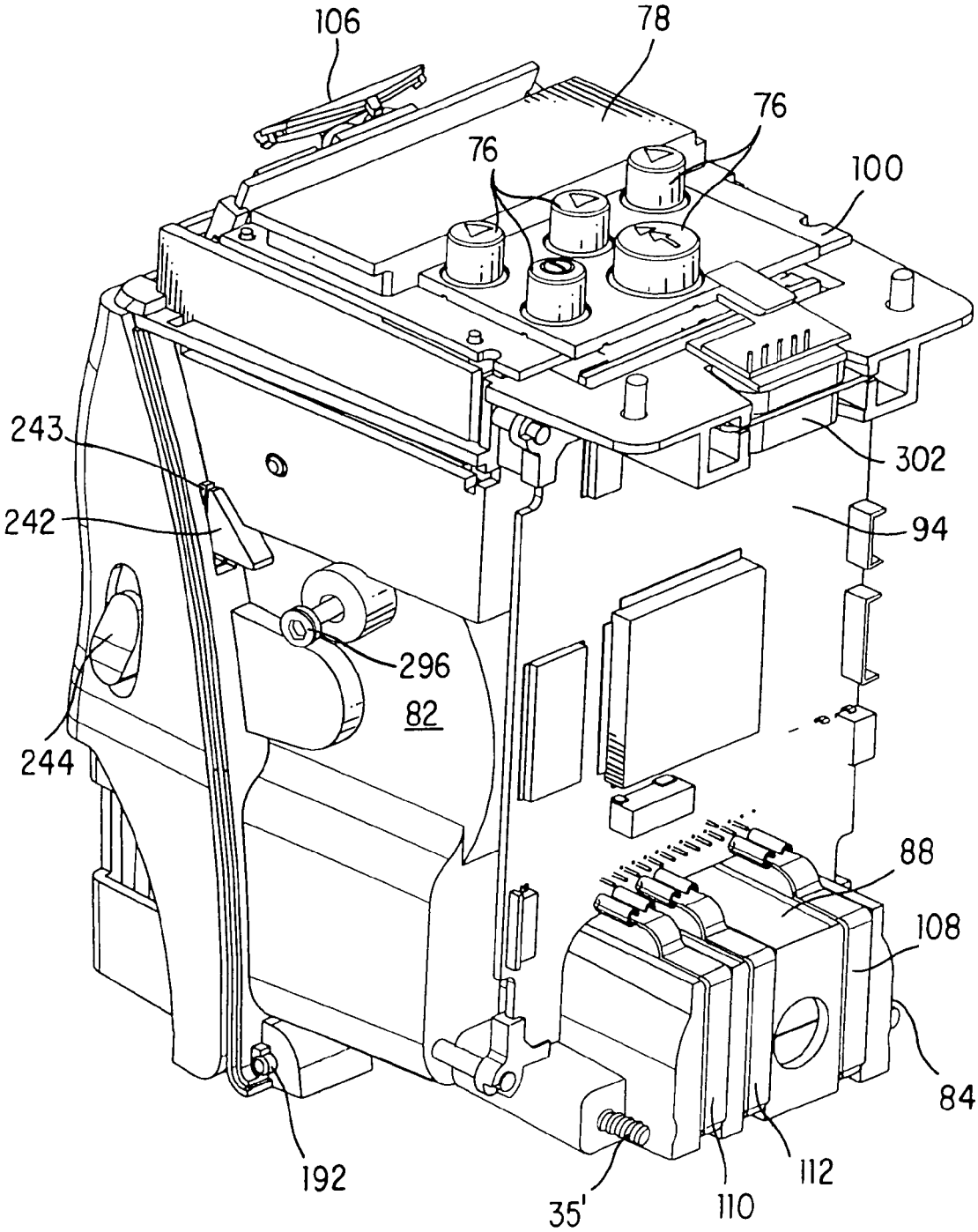
FIG. 7 is a perspective view of the printer with the housing removed.

A cup-shaped cover 300 is snap-fitted into a hollow pocket 301 in the rear wall 32 of the housing 28. A cable (not shown) is plugged into a connector 302 (FIG. 7) and the cable passes inside the cover 300 and exits the printer via a hole 303 and a port 304. Bottom wall 304 of the cover can flex and resiliently hold the cable between the bottom wall 304 and the bottom 305 of the pocket 301.

Figure 25:
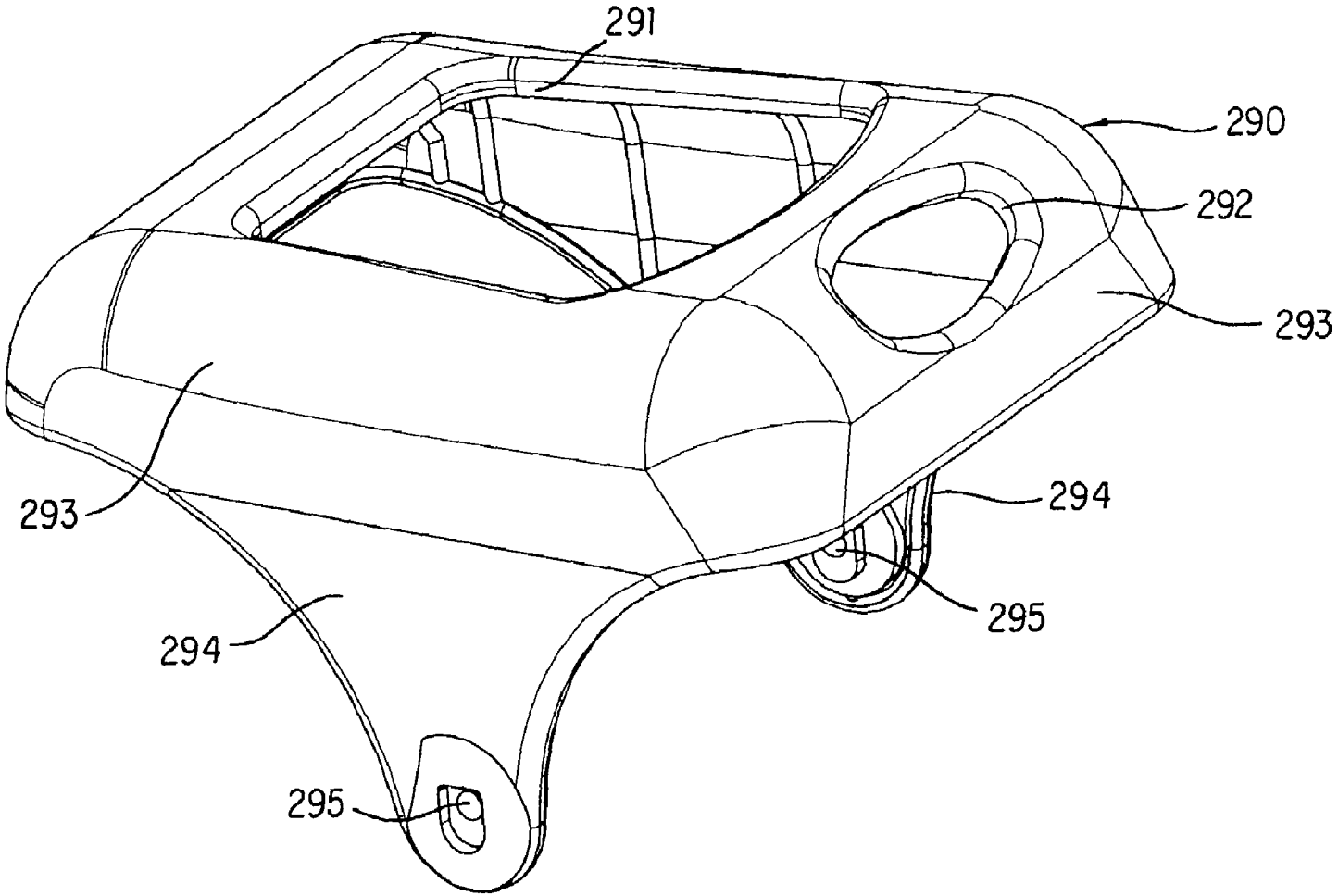
FIG. 25 is a perspective view of a resilient elastomeric protector pad for the upper portion of the printer.
Figure 26:
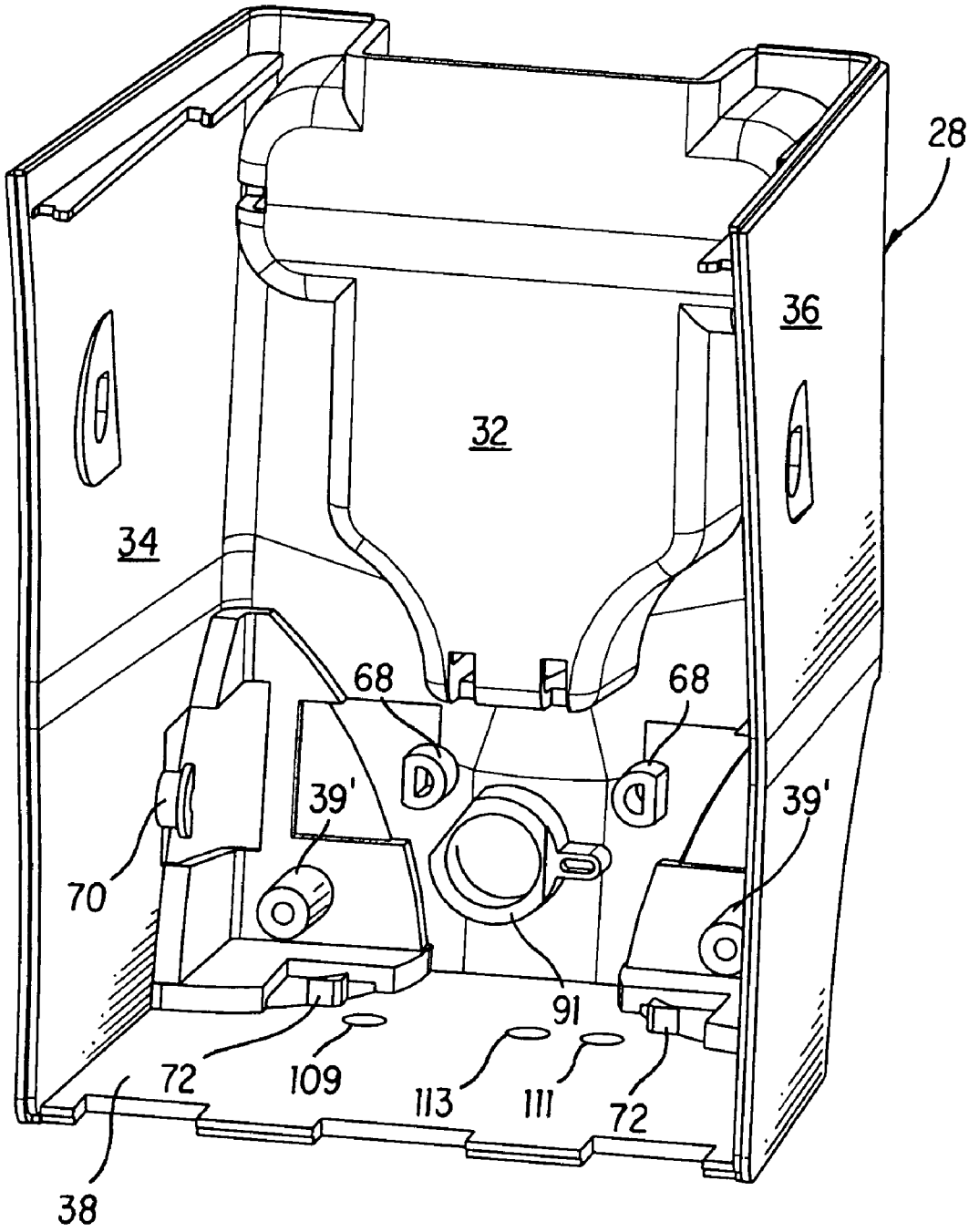
FIG. 26 is a perspective view showing the inside of the housing.

With reference to FIG. 25, a protector pad 290 is shown to cover the entire top portion 74 of the printer with the exception of access openings 291 and 292. The pad 290 is also shown in FIG. 5 but is omitted from the other figures for the sake of clarity. The pad 290 is generally rectangular but has a continuous depending shoulder 293. The long sides of the pad 290 has depending flaps 294 with holes 295 for receiving posts 296. The posts 296 can also serve as anchors for a carrying strap (not shown) by which the printer 26 may be worn or carried at the user's waist.

Except for the springs 170, 182, 228 and 252, various fasteners, the motor 130, the battery 86, various electrical conductors, the tear bar 162, various printed circuit board components, rods 166 and 187, and shafts 176 and 270, the printer is constructed of molded plastics material and the platen rolls 174 and 280 are composed of elastomeric material.

Figure 27:
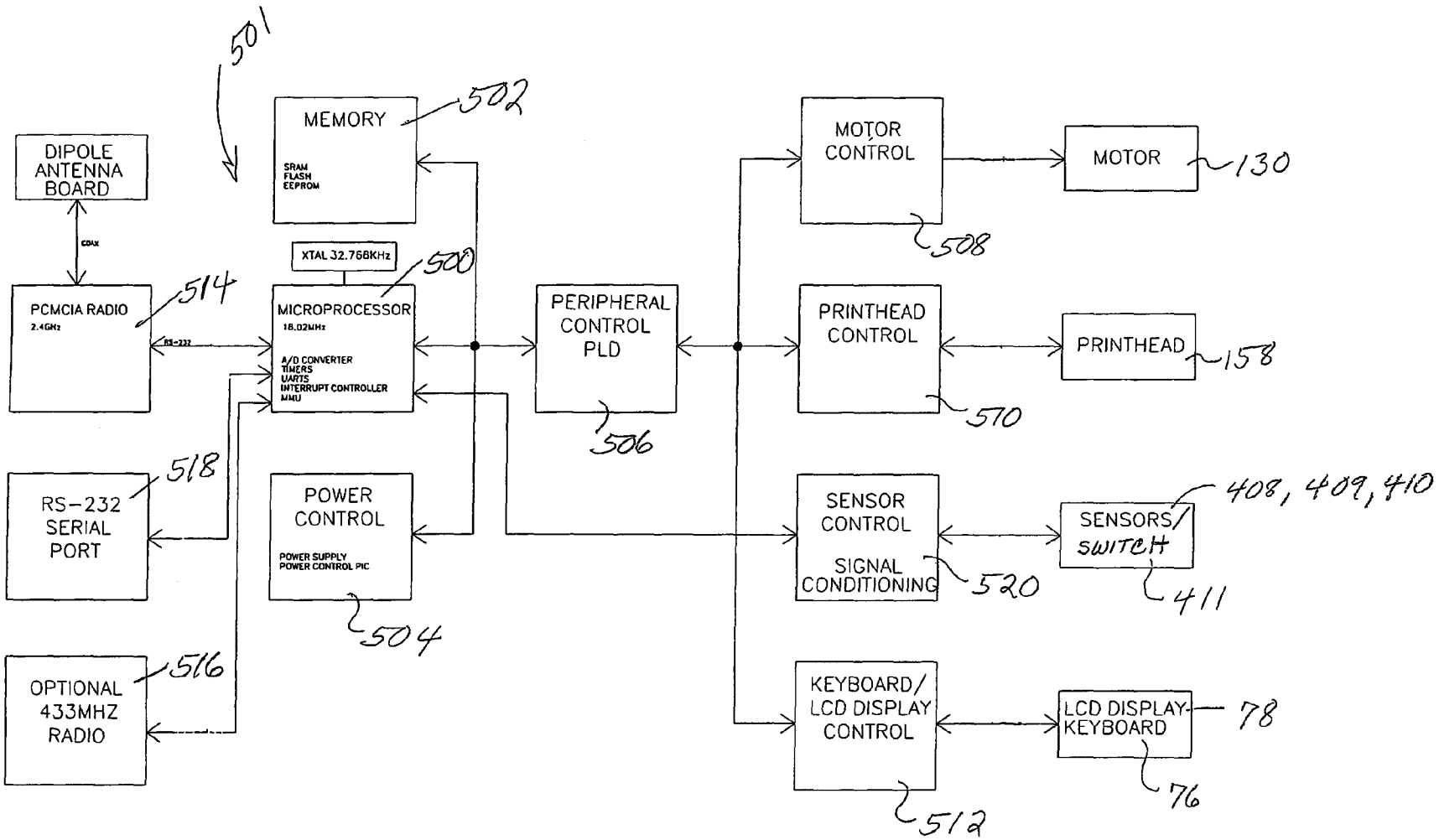
FIG. 27 is a block diagram illustrating the electrical components of the printer.

As shown in FIG. 27, the printer 26 includes a controller 501 having a microprocessor 500 with associated memory 502 for controlling various operations of the printer 26. The memory 502 may include, for example, a RAM, Flash memory and/or an EEPROM for storing firmware, application programs, printing formats, variable data and data to be printed, etc. The printer 26 is preferably battery powered as discussed above, to enable the printer 26 to be portable, the battery 86 being included in a power control 504. The microprocessor 500, via a peripheral control 506 and a motor control 508, controls the motor 130 that drives the platen roll 174 to advance one of the webs W1, W2, or W3. The microprocessor 500 also controls the print head 158 and display 78 via the peripheral control 506 and a respective print head control 510 and keyboard/LCD display control 512. A communication interface includes a 2.4 GHz radio 514 or a 433 MHz radio 516 and/or a RS232 port 518 to allow the printer to communicate with a host device. The host device may be a data terminal with/or without a barcode scanner or a host computer, etc. from which the controller 26 receives data to be printed and printing format information. The microprocessor 500 may also transmit information to the host device as discussed below.

Figure 28:
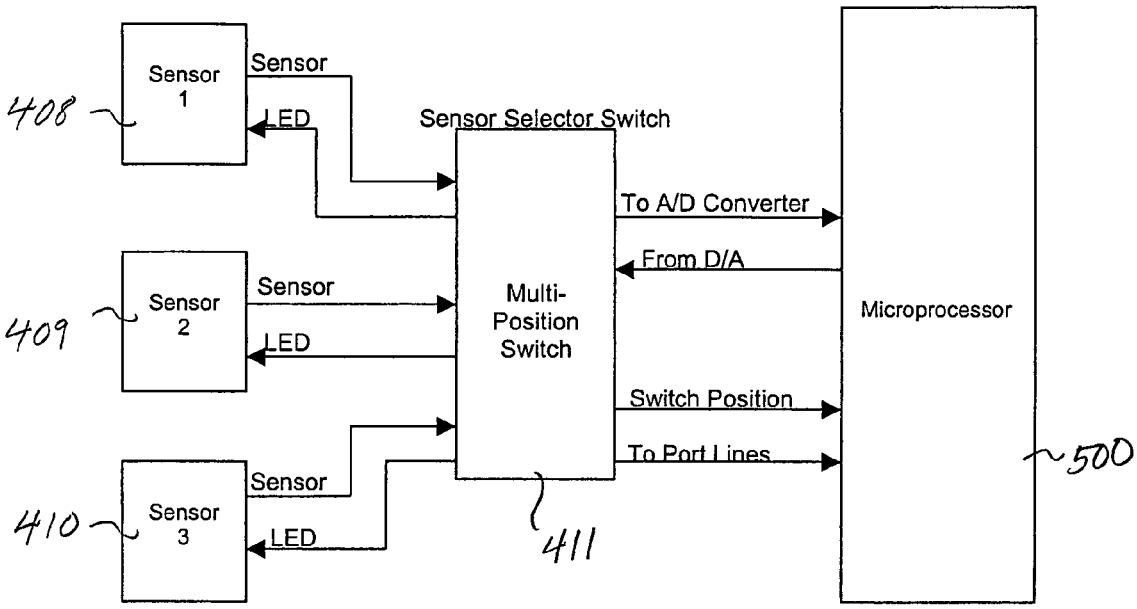
FIG. 28 is a block diagram illustrating web registration sensors and a switch for coupling the sensors to a microprocessor of the printer.

The microprocessor 500 controls the motor 130 and print head 158 for printing in response to the inputs from various sensors including the web registration sensors 408, 409 and 410 which cooperate with marks 400, 400' and 400 respectively to sense the position of a respective web W1, W3 and W2 with respect to the print head 158. The sensors 408, 409, 410 are coupled to the microprocessor 500 via the switch 411 and a sensor control signal conditioning circuit 520. As shown in FIG. 28, the switch 411 couples one of the sensors 408, 409 and 410 to the microprocessor 500. The microprocessor 500 turns on the sensor and in particular the LED of the sensor that is associated with the web to be printed on. The microprocessor 500 receives via the switch 411 web positioning or registration information from the sensor associated with the web to be printed on to enable the microprocessor 500 to control printing of the print data in the desired area on the web as indicated by a selected printing format.

Figure 29A:
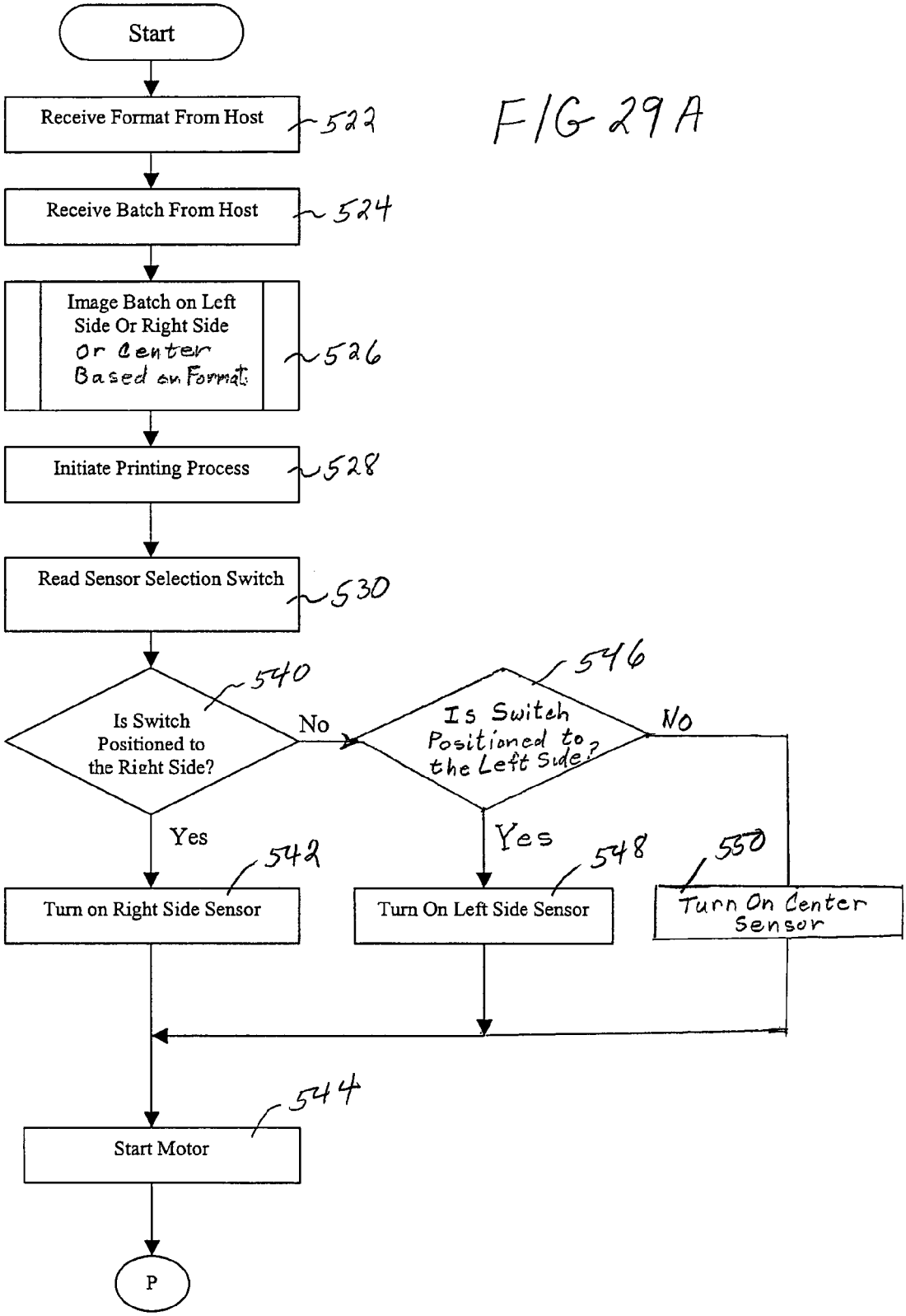
FIGS. 29A-C form a flow chart illustrating a printing operation of the printer.
Figure 29B:
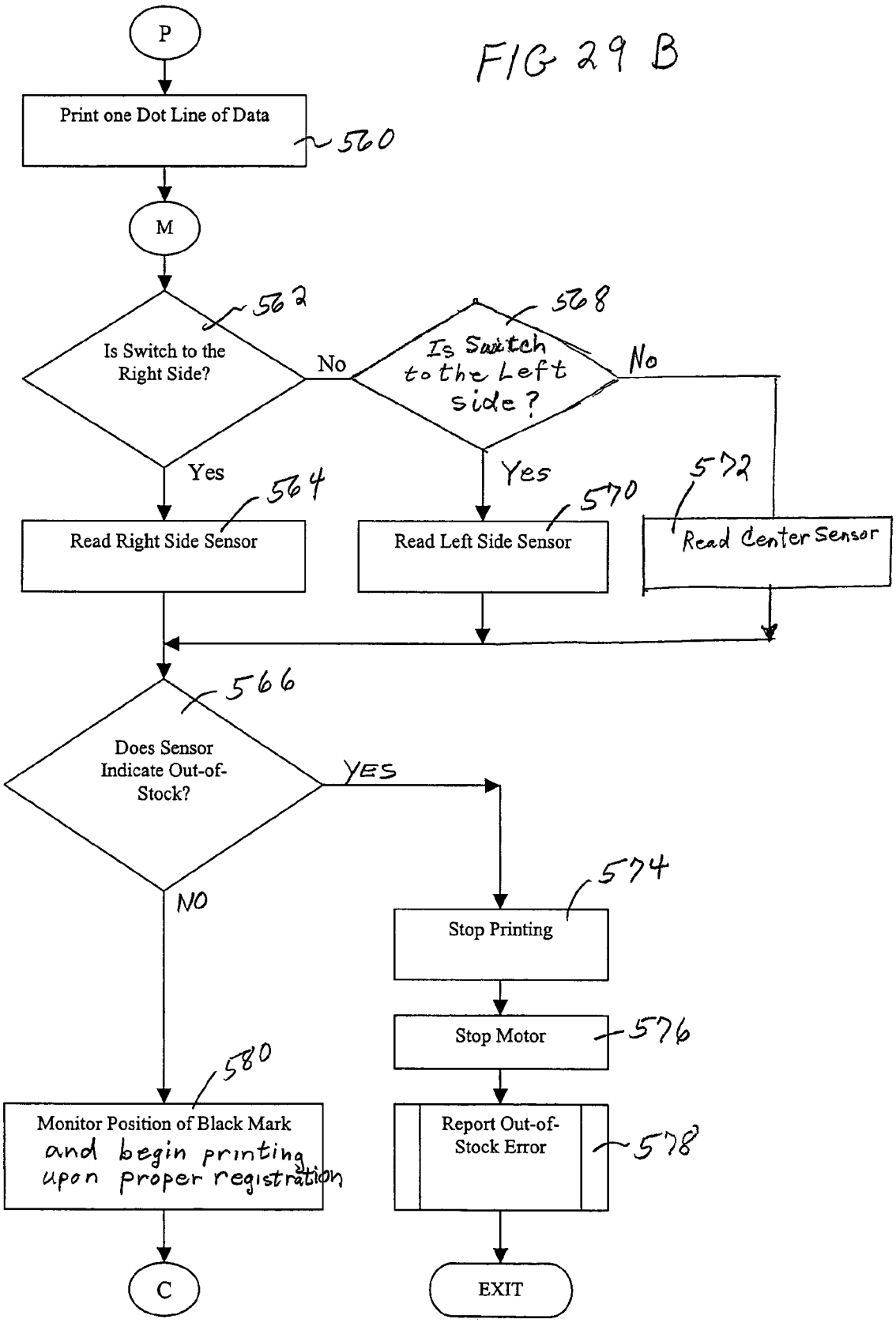
Figure 29C:
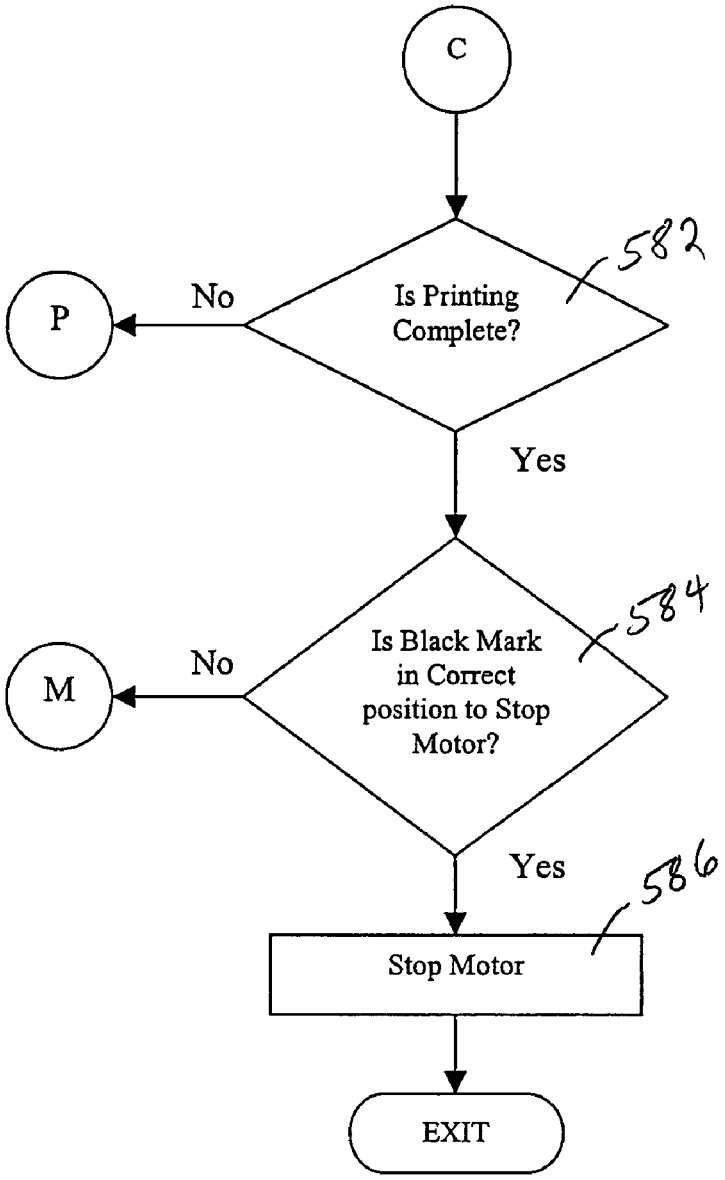

The microprocessor 500 controls the printer 26 to print in accordance with the flow chart depicted in FIGS. 29A-C. At block 522, the microprocessor 500 receives format information from a host device via the communication interface. At block 524, the microprocessor receives batch, printing data from the host to be printed in accordance with the format received at block 522. The microprocessor thereafter, at block 526, images the printing data received at block 524 on the left side, right side or center in a print image portion of the memory based on the format information received at block 522. At block 528, the microprocessor 500 initiates the printing process. The microprocessor at block 530 reads the position of the web selection switch 411 to determine if the switch is positioned to the right side indicating that the web W1 is to be printed on. If so, the microprocessor 500 proceeds to block 542 to turn on the right side web registration sensor 408. If the microprocessor 500 determines at block 540 that the switch position is not to the right side, the microprocessor 500 proceeds from block 540 to block 546. At block 546, the microprocessor 500 determines whether the switch 411 is positioned to the left side indicating that the web W2 is to be printed on. If so, the microprocessor 500 proceeds to block 548 to turn on the left side web registration sensor 410 associated with the web W2. If the microprocessor 500 determines at block 546 that the switch 411 is not positioned to the left side, the switch 411 is determined to be in the center position indicating that the web W3 is to be printed on and at block 550, the microprocessor 500 turns on the center web registration sensor 409. With reference to FIG. 29A, from blocks 542, 548 or 550, the microprocessor 500 proceeds to block 544 to start the motor 130 to advance the web to be printed on.

The microprocessor 500 at block 560 (FIG. 29B) sends one dot line of data to the print head 158. Thereafter, at block 562, the microprocessor 500 determines whether the switch 411 is to the right side and if so, the microprocessor proceeds to block 564 to read the right side sensor 408. If the microprocessor determines at block 562 that the switch 411 is not to the right side, the microprocessor proceeds to block 568. At block 568, the microprocessor 500 determines whether the switch 411 is to the left side and if so, the microprocessor proceeds to block 570 to read the left side sensor 410. If the microprocessor 500 determines at block 568 that the switch is not to the left side, indicating that the switch is in the center position, the microprocessor proceeds to block 572 to read the center sensor 409. From blocks 564, 570 or 572, the microprocessor proceeds to block 566 to determine whether the web registration sensor indicates an out-of-stock condition. If so, the microprocessor proceeds to block 574 to stop the printing operation by the print head 158. Thereafter, the motor 130 is stopped at block 576 and at block 578, the microprocessor 500 reports an out-of-stock error. If the sensor does not indicate an out-of-stock condition, the microprocessor proceeds from block 566 to block 580.

At block 580, the microprocessor 50 monitors the position of a black mark or sensor mark on the web as sensed by sensor 408, 409 or 410 associated with the web to be printed on to begin printing upon proper registration of the web and in particular a label with the print head 158. From block 580, the microprocessor proceeds to block 582 to determine whether the printing of a label has been completed. If not, the microprocessor proceeds back to block 560 to print the next dot line of data on the label. If printing of a label is complete, the microprocessor 500 proceeds from block 582 to block 584 to determine whether the registration mark or sense mark RW is in the correct position to stop the motor 130 based on information received from the web registration sensor. If so, the microprocessor 500 stops the motor 130 at block 586.

In another embodiment of the present invention, the switch 411 may be eliminated and the web registration sensors 408, 409 and 410 can be used to automatically detect which of the webs W1, W3 or W2 is being advanced through the printer so that the web can be printed on. In still another embodiment, the printer 26 includes a single web registration sensor that is movable into a right side position to sense registration of the web W1, into a left side position to sense the registration of the web W2 and into a center position to sense the registration of the web W3. In this embodiment, the position of the web registration sensor identifies the web selected to be printed on. In another embodiment, when the microprocessor 500 receives a print format from a host device, the microprocessor checks to see whether the format is a proper format for the selected web, for example, a right side format for the right side web, as indicated by the switch 411 or web registration sensor. If the received format is not a proper format for printing on the selected web in the position as indicated by the switch 411 or the sensors, the microprocessor 500 generates an error message to be depicted on the display 512 to alert the user and/or the microprocessor 500 transmits an error message to the host device so that the host device can send down a proper format associated with the web selected to be printed on. In still another embodiment, the controller 501 stores a number of printing formats including at least one printing format associated with each of the printing positions of the webs W1, W2 and W3. The microprocessor 500 selects one of the stored printing formats based on the web selected to be printed on as indicated by the switch 411 or web registration sensor. As an example, the printer selects a right side format for the right side web W1. In a further embodiment, the microprocessor 500 transmits via the communication interface to the host device the identity of the web selected to be printed on as indicated by the switch 411 or a web registration sensor. In response to the receipt of the web identity or web position information, the host device downloads to the printer 26 a format associated with the web position, i.e. web to be printed on, wherein the format information received is stored for use by the microprocessor 500 before printing Other embodiments and modifications of the invention will suggest themselves to those skilled in the art, and all such of these as come within the spirit of this invention are included within its scope as best defined by the appended claims.

What is claimed is:

1. A printer, comprising: an elongate transversely extending thermal print head and a cooperable platen roll, the printer having space for receiving a plurality of label rolls comprised of webs, wherein there are different side-by-side longitudinally extending web paths transverse to the print head and platen roll, a single electric motor for driving the platen roll to advance any one of the webs along its related web path into printing cooperation with the print head, wherein the elongate print head and the platen roll span all the web paths, a plurality of registration sensors, wherein one of the registration sensors is disposed along each web path, a user-selectable switch for enabling only the registration sensor in the selected web path, and a controller coupled to the registration sensors, the switch, the motor and the print head for controlling printing on the selected web.

2. A printer as defined in claim 1, wherein the switch has at least two operative positions.

3. A printer as defined in claim 1, wherein the switch is a three-position switch.

4. Method of printing, comprising: providing a printer having an elongate transversely extending thermal print head having a line of dot heating elements, a driven platen roll cooperable with the print head, a plurality of transversely spaced registration sensors with each sensor being disposed along a separate one of a plurality of longitudinally extending transversely disposed web paths with the sensors being for use in registering the label webs with respect to the print head, wherein the elongate print head and the platen roll are positioned so that the line of dot heating elements spans the web paths, selecting the web to be printed, threading only the selected web along its path between the print head and the platen roll, turning on only the sensor corresponding to the web path for the selected web, advancing the selected web, and printing on the selected web.

* * * * *